US009945520B2

(12) United States Patent
Jiang et al.

(10) Patent No.: US 9,945,520 B2
(45) Date of Patent: Apr. 17, 2018

(54) LED TUBE LAMP

(71) Applicant: JIAXING SUPER LIGHTING ELECTRIC APPLIANCE CO., LTD, Zhejiang (CN)

(72) Inventors: Tao Jiang, Zhejiang (CN); Hong Xu, Zhejiang (CN); Liqin Li, Zhejiang (CN); Chang Yang, Zhejiang (CN)

(73) Assignee: JIAXING SUPER LIGHTING ELECTRIC APPLIANCE CO., LTD, Zhejiang (CN)

( * ) Notice: Subject to any disclaimer, the term of this patent is extended or adjusted under 35 U.S.C. 154(b) by 0 days.

(21) Appl. No.: 15/483,368

(22) Filed: Apr. 10, 2017

(65) Prior Publication Data

US 2017/0211753 A1 Jul. 27, 2017

Related U.S. Application Data

(63) Continuation of application No. 15/211,717, filed on Jul. 15, 2016, now Pat. No. 9,618,168, and a (Continued)

(30) Foreign Application Priority Data

Sep. 28, 2014 (CN) ..... 2014 1 0507660
Sep. 28, 2014 (CN) ..... 2014 1 0508899

(Continued)

(51) Int. Cl.
*H05B 37/00* (2006.01)
*H05B 39/00* (2006.01)

(Continued)

(52) U.S. Cl.
CPC ..... *F21K 9/272* (2016.08); *F21K 9/278* (2016.08); *F21V 3/02* (2013.01); *F21V 3/0418* (2013.01);

(Continued)

(58) Field of Classification Search
None
See application file for complete search history.

(56) References Cited

U.S. PATENT DOCUMENTS 2,454,049 A 11/1948 Floyd, Jr.
3,294,518 A 12/1966 Laseck et al.

(Continued)

FOREIGN PATENT DOCUMENTS

CN 201014273 Y 1/2008
CN 201363601 12/2009

(Continued)

*Primary Examiner* — Anh Tran
(74) *Attorney, Agent, or Firm* — Andrew M. Calderon; Roberts Mlotkowski Safran Cole & Calderon, P.C.

(57) ABSTRACT

An LED tube lamp includes a glass tube, a plurality of LED light sources, two end caps respectively sleeving two end portions of the glass tube, a power supply in one of the end caps or separately in both of the end caps, and an LED light strip in the glass tube. The plurality of LED light sources is on the LED light strip. Each of the end caps comprises a plurality of openings formed thereon. The plurality of openings dissipating heat resulted from the power supply are divided into two sets. The two sets of the plurality of openings are symmetric to each other with respect to a virtual central axis of the end cap.

68 Claims, 14 Drawing Sheets

Related U.S. Application Data continuation-in-part of application No. 14/865,387, filed on Sep. 25, 2015, now Pat. No. 9,609,711, and a continuation-in-part of application No. 15/056,121, filed on Feb. 29, 2016, now Pat. No. 9,447,929, and a continuation-in-part of application No. 15/168,962, filed on May 31, 2016, and a continuation-in-part of application No. PCT/CN2015/096502, filed on Dec. 5, 2015, and a continuation-in-part of application No. 15/087,092, filed on Mar. 31, 2016.

(30) Foreign Application Priority Data

| | | |
|---|---|---|
| Nov. 6, 2014 | (CN) | 2014 1 0623355 |
| Dec. 5, 2014 | (CN) | 2014 1 0734425 |
| Feb. 12, 2015 | (CN) | 2015 1 0075925 |
| Mar. 10, 2015 | (CN) | 2015 1 0104823 |
| Mar. 25, 2015 | (CN) | 2015 1 0133689 |
| Mar. 26, 2015 | (CN) | 2015 1 0134586 |
| Mar. 27, 2015 | (CN) | 2015 1 0136796 |
| Apr. 3, 2015 | (CN) | 2015 1 0155807 |
| Apr. 14, 2015 | (CN) | 2015 1 0173861 |
| Apr. 22, 2015 | (CN) | 2015 1 0193980 |
| May 19, 2015 | (CN) | 2015 1 0259151 |
| May 22, 2015 | (CN) | 2015 1 0268927 |
| May 29, 2015 | (CN) | 2015 1 0284720 |
| Jun. 10, 2015 | (CN) | 2015 1 0315636 |
| Jun. 12, 2015 | (CN) | 2015 1 0324394 |
| Jun. 17, 2015 | (CN) | 2015 1 0338027 |
| Jun. 26, 2015 | (CN) | 2015 1 0364735 |
| Jun. 26, 2015 | (CN) | 2015 1 0372375 |
| Jun. 26, 2015 | (CN) | 2015 1 0373492 |
| Jun. 29, 2015 | (CN) | 2015 1 0378322 |
| Jul. 2, 2015 | (CN) | 2015 1 0391910 |
| Jul. 10, 2015 | (CN) | 2015 1 0406595 |
| Jul. 20, 2015 | (CN) | 2015 1 0428680 |
| Jul. 27, 2015 | (CN) | 2015 1 0448220 |
| Aug. 7, 2015 | (CN) | 2015 1 0482944 |
| Aug. 8, 2015 | (CN) | 2015 1 0483475 |
| Aug. 8, 2015 | (CN) | 2015 1 0486115 |
| Aug. 14, 2015 | (CN) | 2015 1 0499512 |
| Sep. 2, 2015 | (CN) | 2015 1 0555543 |
| Sep. 6, 2015 | (CN) | 2015 1 0557717 |
| Sep. 18, 2015 | (CN) | 2015 1 0595173 |
| Oct. 8, 2015 | (CN) | 2015 1 0645134 |
| Oct. 29, 2015 | (CN) | 2015 1 0716899 |
| Nov. 27, 2015 | (CN) | 2015 1 0848766 |
| Dec. 2, 2015 | (CN) | 2015 1 0868263 |
| Jan. 22, 2016 | (CN) | 2016 1 0044148 |
| Mar. 25, 2016 | (CN) | 2016 1 0177706 |
| May 18, 2016 | (CN) | 2016 1 0327806 |

(51) Int. Cl.

| | |
|---|---|
| ***H05B 41/14*** | (2006.01) |
| ***F21K 9/272*** | (2016.01) |
| ***F21K 9/278*** | (2016.01) |
| ***F21V 29/83*** | (2015.01) |
| ***F21V 3/04*** | (2018.01) |
| ***F21V 23/06*** | (2006.01) |
| ***F21V 17/10*** | (2006.01) |
| ***F21V 3/02*** | (2006.01) |
| *F21Y 115/10* | (2016.01) |
| *F21Y 103/10* | (2016.01) |

(52) U.S. Cl.

CPC ..... *F21V 3/061* (2018.02); *F21V 17/101* (2013.01); *F21V 23/06* (2013.01); *F21V 29/83* (2015.01); *F21Y 2103/10* (2016.08); *F21Y 2115/10* (2016.08)

(56) References Cited

U.S. PATENT DOCUMENTS

| | | | | |
|---|---|---|---|---|
| 4,156,265 | A | 5/1979 | Rose | |
| 4,647,399 | A | 3/1987 | Peters et al. | |
| 5,575,459 | A | 11/1996 | Anderson | |
| 5,921,660 | A | 7/1999 | Yu | |
| 6,118,072 | A | 9/2000 | Scott | |
| 6,127,783 | A | 10/2000 | Pashley et al. | |
| 6,186,649 | B1 | 2/2001 | Zou et al. | |
| 6,211,262 | B1 | 4/2001 | Mejiritski et al. | |
| 6,609,813 | B1 | 8/2003 | Showers et al. | |
| 6,796,680 | B1 | 9/2004 | Showers et al. | |
| 6,860,628 | B2 | 3/2005 | Robertson et al. | |
| 6,936,855 | B1 | 8/2005 | Harrah et al. | |
| 7,033,239 | B2 | 4/2006 | Cunkelman et al. | |
| 7,067,032 | B1 | 6/2006 | Bremont et al. | |
| 7,594,738 | B1 | 9/2009 | Lin et al. | |
| 8,360,599 | B2 | 1/2013 | Ivey et al. | |
| 8,456,075 | B2 | 6/2013 | Axelsson | |
| 8,579,463 | B2 | 11/2013 | Clough | |
| D761,216 | S | 7/2016 | Jiang | |
| 9,447,929 | B2 | 9/2016 | Jiang | |
| D768,891 | S | 10/2016 | Jiang et al. | |
| 9,618,168 | B1 | 4/2017 | Jiang et al. | |
| D797,323 | S | 9/2017 | Yang et al. | |
| 2002/0044456 | A1 | 4/2002 | Balestriero et al. | |
| 2003/0189829 | A1 | 10/2003 | Shimizu et al. | |
| 2003/0231485 | A1 | 12/2003 | Chien | |
| 2004/0095078 | A1 | 5/2004 | Leong | |
| 2004/0189218 | A1 | 9/2004 | Leong | |
| 2005/0128751 | A1 | 6/2005 | Roberge et al. | |
| 2005/0162850 | A1 | 7/2005 | Luk et al. | |
| 2005/0168123 | A1 | 8/2005 | Taniwa | |
| 2005/0185396 | A1 | 8/2005 | Kutler | |
| 2005/0207166 | A1 | 9/2005 | Kan et al. | |
| 2005/0213321 | A1 | 9/2005 | Lin | |
| 2006/0028837 | A1 | 2/2006 | Mrakovich et al. | |
| 2007/0001709 | A1 | 1/2007 | Shen | |
| 2007/0145915 | A1 | 6/2007 | Roberge et al. | |
| 2007/0210687 | A1 | 9/2007 | Axelsson | |
| 2007/0274084 | A1 | 11/2007 | Kan et al. | |
| 2008/0030981 | A1 | 2/2008 | Mrakovich et al. | |
| 2008/0192476 | A1 | 8/2008 | Hiratsuka | |
| 2008/0278941 | A1 | 11/2008 | Logan et al. | |
| 2008/0290814 | A1* | 11/2008 | Leong | F21K 9/00 315/294 |
| 2009/0140271 | A1 | 6/2009 | Sah | |
| 2009/0159919 | A1 | 6/2009 | Simon et al. | |
| 2009/0161359 | A1 | 6/2009 | Siemiet et al. | |
| 2010/0085772 | A1 | 4/2010 | Song et al. | |
| 2010/0135015 | A1* | 6/2010 | Liu | F21V 29/006 362/235 |
| 2010/0177532 | A1 | 7/2010 | Simon et al. | |
| 2010/0201269 | A1 | 8/2010 | Tzou | |
| 2010/0220469 | A1 | 9/2010 | Ivey et al. | |
| 2010/0253226 | A1 | 10/2010 | Oki | |
| 2010/0277918 | A1 | 11/2010 | Chen et al. | |
| 2011/0038146 | A1* | 2/2011 | Chen | F21V 19/001 362/225 |
| 2011/0057572 | A1 | 3/2011 | Kit et al. | |
| 2011/0084554 | A1 | 4/2011 | Tian et al. | |
| 2011/0084608 | A1 | 4/2011 | Lin et al. | |
| 2011/0084627 | A1 | 4/2011 | Sloan et al. | |
| 2011/0090684 | A1 | 4/2011 | Logan et al. | |
| 2011/0216538 | A1 | 9/2011 | Logan et al. | |
| 2011/0279063 | A1 | 11/2011 | Wang et al. | |
| 2011/0309745 | A1 | 12/2011 | Westermarck | |
| 2012/0049684 | A1 | 3/2012 | Bodenstein et al. | |
| 2012/0069556 | A1 | 3/2012 | Bertram et al. | |
| 2012/0106157 | A1 | 5/2012 | Simon et al. | |

(56) References Cited

U.S. PATENT DOCUMENTS

| | | | |
|---|---|---|---|
| 2012/0146503 | A1 | 6/2012 | Negley et al. |
| 2012/0153873 | A1 | 6/2012 | Hayashi et al. |
| 2012/0169968 | A1 | 7/2012 | Ishimori et al. |
| 2012/0212951 | A1 | 8/2012 | Lai et al. |
| 2012/0293991 | A1 | 11/2012 | Lin |
| 2012/0319150 | A1 | 12/2012 | Shimomura et al. |
| 2013/0021809 | A1 | 1/2013 | Dellian et al. |
| 2013/0033881 | A1 | 2/2013 | Terazawa et al. |
| 2013/0033888 | A1 | 2/2013 | Wel et al. |
| 2013/0050998 | A1 | 2/2013 | Chu et al. |
| 2013/0069538 | A1 | 3/2013 | So |
| 2013/0094200 | A1 | 4/2013 | Dellian et al. |
| 2013/0135852 | A1 | 5/2013 | Chan |
| 2013/0170196 | A1 | 7/2013 | Huang et al. |
| 2013/0170245 | A1 | 7/2013 | Hong et al. |
| 2013/0182425 | A1 | 7/2013 | Seki et al. |
| 2013/0223053 | A1 | 8/2013 | Liu et al. |
| 2013/0230995 | A1 | 9/2013 | Ivey et al. |
| 2013/0250565 | A1 | 9/2013 | Chiang et al. |
| 2013/0256704 | A1 | 10/2013 | Hsiao et al. |
| 2013/0258650 | A1 | 10/2013 | Sharrah |
| 2013/0293098 | A1 | 11/2013 | Li et al. |
| 2014/0071667 | A1 | 3/2014 | Hayashi et al. |
| 2014/0153231 | A1 | 6/2014 | Bittmann |
| 2014/0192526 | A1 | 7/2014 | Qiu |
| 2014/0225519 | A1 | 8/2014 | Yu |
| 2014/0226320 | A1 | 8/2014 | Halliwell et al. |
| 2015/0009688 | A1 | 1/2015 | Timmermans et al. |
| 2015/0173770 | A1* | 6/2015 | Warner ..... A61B 17/12136 606/200 |
| 2015/0176770 | A1 | 6/2015 | Wilcox et al. |
| 2015/0327368 | A1 | 11/2015 | Su |
| 2016/0081147 | A1* | 3/2016 | Guang ..... H05B 33/0803 315/123 |
| 2016/0091156 | A1 | 3/2016 | Li et al. |
| 2016/0091179 | A1 | 3/2016 | Jiang et al. |
| 2016/0178137 | A1 | 6/2016 | Jiang |
| 2016/0178138 | A1 | 6/2016 | Jiang |
| 2016/0215936 | A1 | 7/2016 | Jiang |
| 2016/0215937 | A1 | 7/2016 | Jiang |
| 2016/0290566 | A1 | 10/2016 | Jiang et al. |
| 2016/0290567 | A1 | 10/2016 | Jiang et al. |
| 2016/0290568 | A1 | 10/2016 | Jiang et al. |
| 2016/0290569 | A1 | 10/2016 | Jiang et al. |
| 2016/0290570 | A1 | 10/2016 | Jiang et al. |
| 2016/0290598 | A1 | 10/2016 | Jiang |
| 2016/0290609 | A1 | 10/2016 | Jiang et al. |
| 2016/0295706 | A1 | 10/2016 | Jiang |
| 2016/0341414 | A1 | 11/2016 | Jiang |
| 2017/0038012 | A1 | 2/2017 | Jiang et al. |
| 2017/0038013 | A1 | 2/2017 | Liu et al. |
| 2017/0038014 | A1 | 2/2017 | Jiang et al. |
| 2017/0089521 | A1 | 3/2017 | Jiang |
| 2017/0130911 | A1 | 5/2017 | Li et al. |
| 2017/0159894 | A1 | 6/2017 | Jiang |
| 2017/0167664 | A1 | 6/2017 | Li et al. |
| 2017/0211753 | A1 | 7/2017 | Jiang et al. |
| 2017/0219169 | A1 | 8/2017 | Jiang |
| 2017/0311398 | A1 | 10/2017 | Jiang et al. |

FOREIGN PATENT DOCUMENTS

| | | | |
|---|---|---|---|
| CN | 201437921 | | 4/2010 |
| CN | 102052652 | | 5/2011 |
| CN | 102116460 | | 7/2011 |
| CN | 102121578 | | 7/2011 |
| CN | 202125774 | | 1/2012 |
| CN | 202216003 | | 5/2012 |
| CN | 102518972 | | 6/2012 |
| CN | 202302841 | | 7/2012 |
| CN | 102720901 | | 10/2012 |
| CN | 102777788 | | 11/2012 |
| CN | 102889446 | | 1/2013 |
| CN | 202791824 | U | 3/2013 |
| CN | 203068187 | | 7/2013 |
| CN | 203240337 | | 10/2013 |
| CN | 203240337 | U | 10/2013 |
| CN | 203363984 | | 12/2013 |
| CN | 203384716 | U | 1/2014 |
| CN | 203413396 | U | 1/2014 |
| CN | 203453866 | U | 2/2014 |
| CN | 203464014 | | 3/2014 |
| CN | 103742875 | | 4/2014 |
| CN | 203549435 | | 4/2014 |
| CN | 203585876 | U | 5/2014 |
| CN | 203615157 | | 5/2014 |
| CN | 103851547 | | 6/2014 |
| CN | 203771102 | | 8/2014 |
| CN | 104033772 | | 9/2014 |
| CN | 203927469 | | 11/2014 |
| CN | 203963553 | U | 11/2014 |
| CN | 204042527 | | 12/2014 |
| CN | 204201535 | U | 3/2015 |
| CN | 204268162 | | 4/2015 |
| CN | 204300737 | | 4/2015 |
| CN | 104595765 | | 5/2015 |
| CN | 204420636 | | 6/2015 |
| CN | 104776332 | | 7/2015 |
| CN | 104832813 | A | 8/2015 |
| CN | 204573639 | | 8/2015 |
| EP | 2554899 | | 2/2013 |
| EP | 3146803 | | 3/2017 |
| GB | 2519258 | | 4/2015 |
| GB | 2523275 | | 8/2015 |
| GB | 2531425 | | 4/2016 |
| JP | 2008117666 | | 5/2008 |
| JP | 2011061056 | | 3/2011 |
| JP | 2014154479 | | 8/2014 |
| KR | 20120000551 | | 1/2012 |
| KR | 1020120055349 | | 5/2012 |
| WO | 2011132120 | | 10/2011 |
| WO | 2012129301 | | 9/2012 |
| WO | 2013125803 | | 8/2013 |
| WO | 2014001475 | | 1/2014 |
| WO | 2014117435 | | 8/2014 |
| WO | 2014118754 | | 8/2014 |
| WO | 2015036478 | | 3/2015 |
| WO | 2015081809 | | 6/2015 |
| WO | 2016086901 | | 6/2016 |

* cited by examiner

LED TUBE LAMP

CROSS-REFERENCE TO RELATED APPLICATIONS

This application is continuation application of U.S. application Ser. No. 15/211,717 filed on Jul. 15, 2016 which is a continuation-in-part application claiming benefits of U.S. application Ser. No. 14/865,387 filed on 2015 Sep. 25, U.S. application Ser. No. 15/056,121 filed on 2016 Feb. 29, and U.S. application Ser. No. 15/168,962 filed on 2016 May 31, the disclosures of which are incorporated herein in their entirety by reference.

TECHNICAL FIELD

The instant disclosure relates to illumination devices, and, more particularly, to an LED tube lamp and components thereof comprising the LED light sources, a tube, electronic components, and end caps.

RELATED ART

LED lighting technology is rapidly developing to replace traditional incandescent and fluorescent lightings. LED tube lamps are mercury-free in comparison with fluorescent tube lamps that need to be filled with inert air and mercury. Thus, it is not surprising that LED tube lamps are becoming a highly desired illumination option among different available lighting systems used in homes and workplaces, which used to be dominated by traditional lighting options such as compact fluorescent light bulbs (CFLs) and fluorescent tube lamps. Benefits of LED tube lamps include improved durability and longevity and far less energy consumption; therefore, when taking into account all factors, they would typically be considered as a cost effective lighting option.

The basic structure of the traditional LED tube lamps include a tube, two end caps at two ends of the tube, a substrate inside the tube, LEDs on the substrate, and a power supply inside the end caps. The substrate disposed inside the tube and having LEDs mounted on is rigid and straight printed circuit board, which makes the tube remain a straight appearance even it is partially ruptured or broken. As a result, user cannot easily aware that the tube is damaged and might be exposed to a dangerous situation.

In addition, the rigid substrate of the traditional LED tube lamp is typically electrically connected with the end caps by way of wire bonding, in which the wires may be easily damaged and even broken due to any move during manufacturing, transportation, and usage of the LED tube lamp and therefore may disable the LED tube lamp.

As the development of LED chips, electro-optical conversion efficiency becomes higher and heat generated from the conversion becomes less. Accordingly, apparatuses utilizing LED chips seldom use ventilating holes to dissipating the heat.

Further, the tube and the end caps of the traditional LED tube lamp are often secured together by tight fit, making the reliability cannot be further improved.

SUMMARY

To address the above issue, the instant disclosure provides embodiments of an LED tube lamp.

According to an embodiment, an LED tube lamp includes a glass tube having two end portions, a plurality of LED light sources, two end caps respectively sleeve the two end portions of the glass tube, a power supply in one of the end caps or separately in both of the end caps, and an LED light strip on an inner surface of the glass tube. The glass tube is covered by a heat shrink sleeve. The glass tube and the end cap are secured by a hot melt adhesive. The plurality of LED light sources is on the LED light strip. Each of the end caps comprises an electrically insulating tube, two conductive pins on the electrically insulating tube; and at least two heat-dissipating openings on the electrically insulating tube symmetric to each other with respect to a plane passing through the middle of a line connecting the two conductive pins and perpendicular to the line connecting the two conductive pins.

According to an embodiment, the hot melt adhesive is, respectively, disposed on the outer surface of the end portions and the shape of the disposed hot melt adhesive is substantially a circle from the side view of the glass tube.

According to an embodiment, the at least two heat-dissipating openings are on a surface of the electrically insulating tube on which the two conductive pins are disposed.

According to an embodiment, the at least two heat-dissipating openings are separately in a shape of an arc.

According to an embodiment, the at least two heat-dissipating openings are in a shape of arcs with different sizes.

According to an embodiment, the sizes of the arcs of the at least two heat-dissipating openings gradually vary.

According to an embodiment, the heat shrink sleeve is substantially transparent with respect to the wavelength of light from the LED light sources.

According to an embodiment, at least a part of the openings are arranged along an arc and spaced apart from each other.

According to an embodiment, the heat and pressure inside the end cap increase during the heating and solidification of the hot melt adhesive, and are then released through at least one opening on the end cap.

According to an embodiment, an LED tube lamp includes a glass tube having an inner surface and an outer surface, a plurality of LED light sources, two end caps respectively at two opposite ends of the glass tube, a power supply in one of the end caps or separately in both of the end caps, and an LED light strip on the inner surface of the glass tube. The plurality of LED light sources is on the LED light strip. Each of the end caps comprises a plurality of openings formed thereon. The plurality of openings dissipating heat resulted from the power supply are divided into two sets. The two sets of the plurality of openings are symmetric to each other with respect to a virtual central axis of the end cap. At least part of the inner surface of the glass tube is formed with a rough surface.

According to an embodiment, the LED tube lamp comprises a hot melt adhesive. The end cap is adhered to one end of the glass tube via the hot melt adhesive.

According to another embodiment, the plurality of openings dissipate heat resulted from the power supply.

According to another embodiment, the hot melt adhesive is heated to be expansive and flowing during a process of having the glass tube and the end cap adhered. The plurality of openings dissipate heat to have the hot melt adhesive cooled and solidified.

According to another embodiment, an LED tube lamp includes a glass tube, a plurality of LED light sources, two end caps respectively at two opposite ends of the glass tube, a power supply in one of the end caps or separately in both of the end caps, and an LED light strip in the glass tube. The plurality of LED light sources is on the LED light strip. Each of the end caps comprises two conductive pins and a plurality of heat-dissipating openings. The two conductive pins are on a surface of the end cap. The plurality of heat-dissipating openings is on the surface of the end cap and divided into two sets. The two sets of the heat-dissipating openings are symmetric to each other with respect to a plane passing through the two conductive pins.

DETAILED DESCRIPTION

Figure 1:
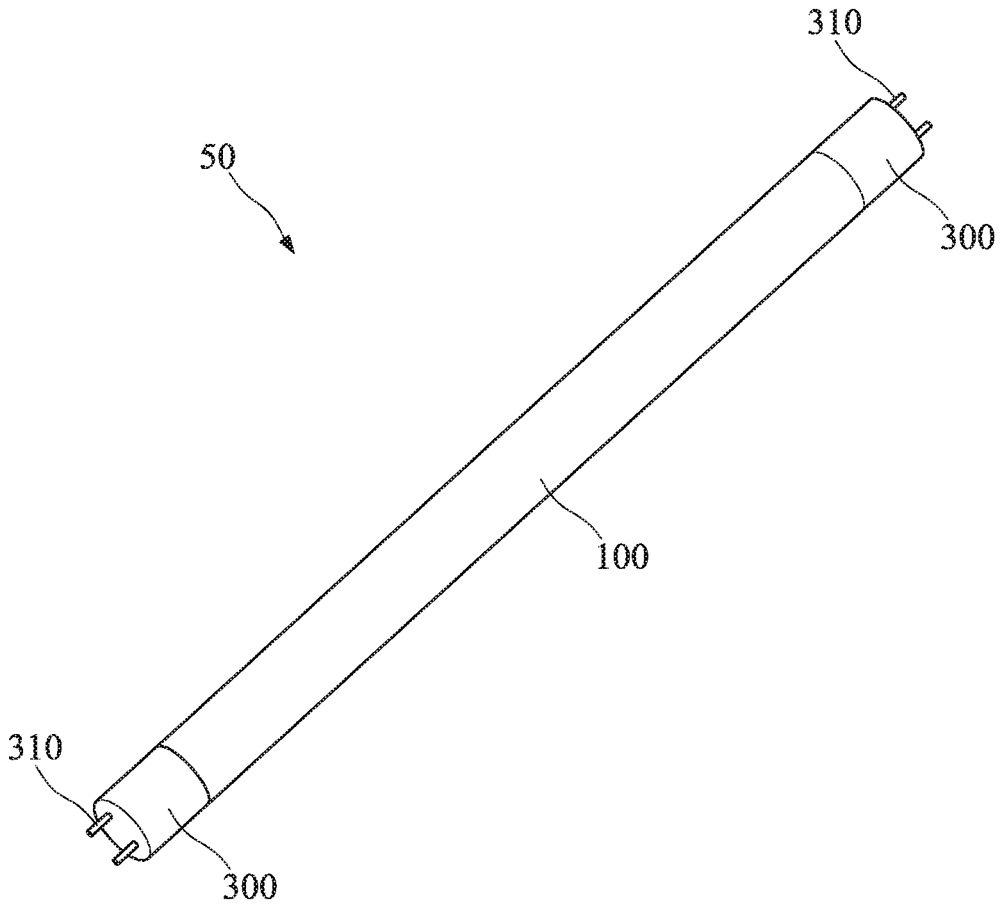
FIG. 1 illustrates a perspective view of an LED tube lamp according to an embodiment of the instant disclosure.

The instant disclosure provides an LED tube lamp to solve the abovementioned problems. The instant disclosure will now be described more fully hereinafter with reference to the accompanying drawings, in which exemplary embodiments of the disclosure are shown. This disclosure may, however, be embodied in many different forms and should not be construed as limitation to the embodiments set forth herein. Rather, these embodiments are provided so that this disclosure will be thorough and complete, and will fully convey the scope of the disclosure to those skilled in the art. Like reference numerals refer to like elements throughout.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," or "includes" and/or "including" or "has" and/or "having" when used herein, specify the presence of stated features, regions, integers, steps, operations, elements, and/or components, but do not preclude the presence or addition of one or more other features, regions, integers, steps, operations, elements, components, and/or groups thereof.

It will be understood that the term "and/or" includes any and all combinations of one or more of the associated listed items. It will also be understood that, although the terms first, second, third etc. may be used herein to describe various elements, components, regions, parts and/or sections, these elements, components, regions, parts and/or sections should not be limited by these terms. These terms are only used to distinguish one element, component, region, part or section from another element, component, region, part or section. Thus, a first element, component, region, part or section discussed below could be termed a second element, component, region, part or section without departing from the teachings of the present disclosure.

The following description with reference to the accompanying drawings is provided to explain the exemplary embodiments of the disclosure. Note that in the case of no conflict, the embodiments of the present disclosure and the features of the embodiments may be arbitrarily combined with each other.

Figure 2:
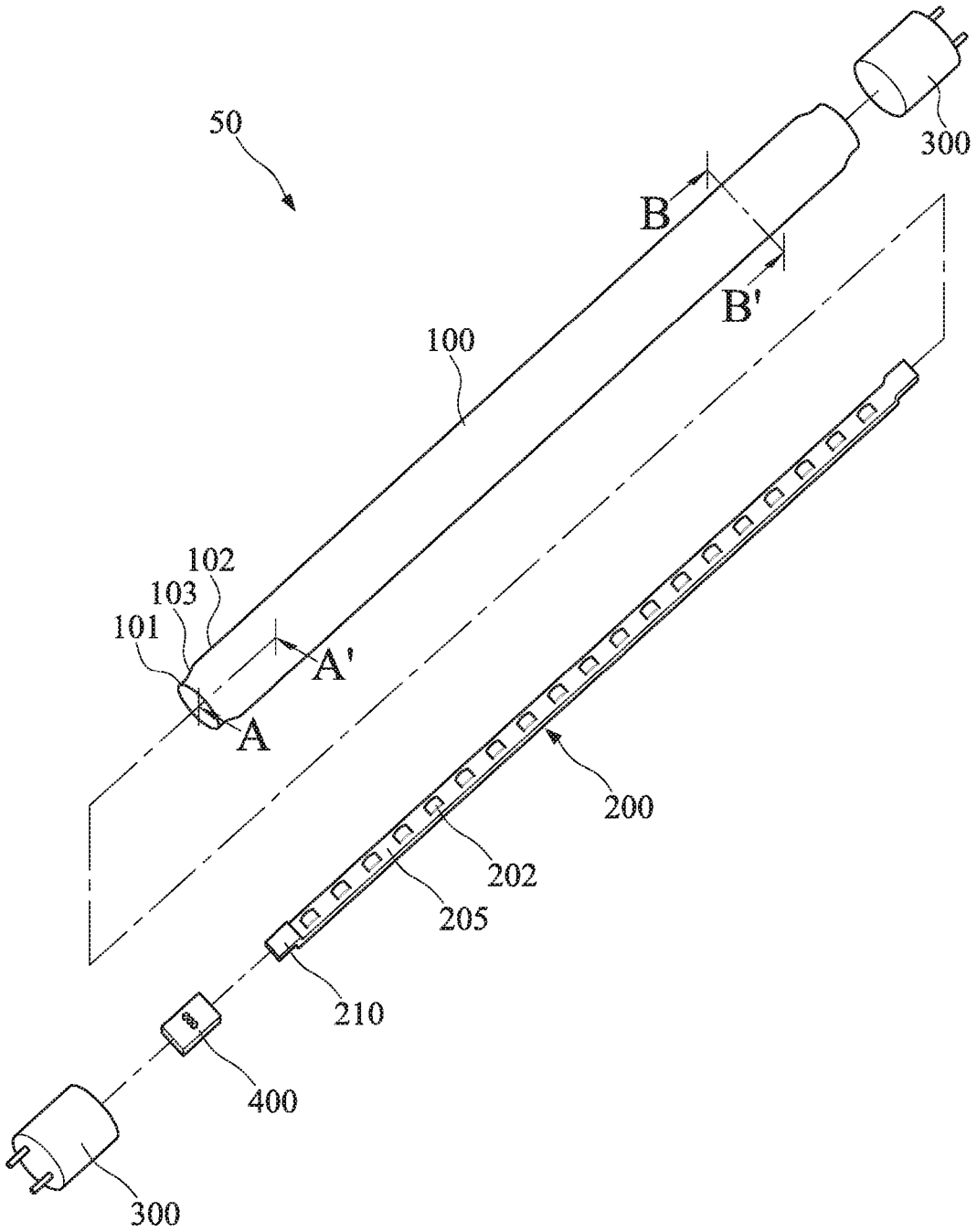
FIG. 2 illustrates an exploded view of an LED tube lamp according to an embodiment of the instant disclosure.
Figure 3:
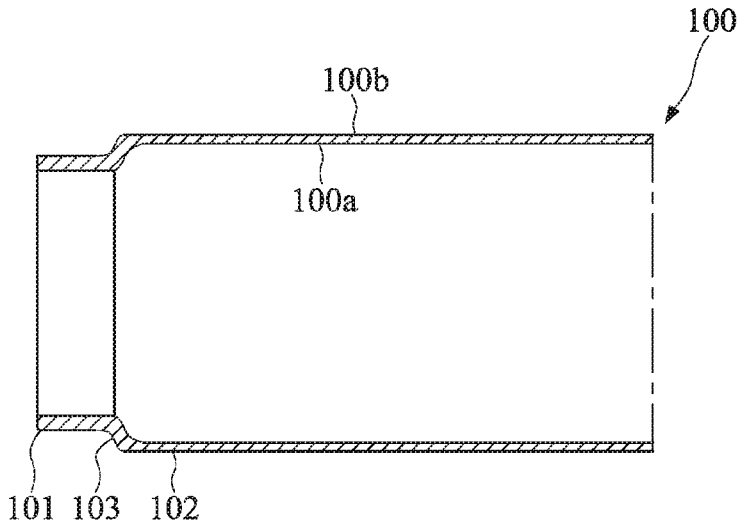
FIG. 3 illustrates a part of cross section of FIG. 2 along line A-A'.

Referring to FIG. 1, FIG. 2, and FIG. 3, the instant disclosure provides an embodiment of an LED tube lamp 50 including a glass tube 100, an LED light strip 200, two end caps 300, and a power supply 400. The glass tube 100 includes an inner surface 100*a* and an outer surface 100*b*. The LED light strip 200 is disposed inside the glass tube 100 and has a bendable circuit sheet 205 mounted on the inner surface 100*a* of the glass tube 100. The two end caps 300, which can have the same size or have different sizes, are respectively disposed on two ends of the glass tube 100 and secured with the glass tube 100 by a hot melt adhesive. The hot melt adhesive may be disposed around the surrounding surfaces between the glass tube 100 and the end caps 300, respectively. In this embodiment, the end caps 300 sleeve, respectively, two end portions of the glass tube 100 and the hot melt adhesive may be surroundingly disposed on the outer surface of the end portions of the glass tube 100. Accordingly, the shape of the disposed hot melt adhesive is substantially a circle from the side view of the glass tube 100 (like the view of FIG. 4). The heat generated during the heating process of the hot melt adhesive will be in a shape of a circle. The degree of vacuum of the glass tube 100 is below 0.001 Pa~1 Pa, and reduce the problem of internal damp. After heating up the hot melt adhesive, and upon expansion due to heat absorption, the hot melt adhesive flows, and then solidifies upon cooling, thereby bonding together the end cap 300 to the glass tube 100 (not shown). The volume of the hot melt adhesive may expand to about 1.3 times the original size when heated from room temperature (e.g., between about 15 and 30 degrees Celsius) to about 200 to 250 degrees Celsius. The end cap 300 and the end of the glass tube 100 could be secured by using the hot melt adhesive and therefore qualified in a torque test of about 1.5 to about 5 newton-meters (Nt-m) and/or in a bending test of about 5 to about 10 newton-meters (Nt-m). During the heating and solidification of the hot melt adhesive, the heat and pressure inside the end cap increase and are then released through at least one opening on the end cap 300. After the hot melt adhesive hardens, the end cap 300 can be firmly fixed to the glass tube 100. Under the circumstances, the end cap 300 and the glass tube 100 is hard to disassemble unless the hardened hot melt adhesive returns to liquid state by certain process. The design of the LED tube lamp 50 is to take into account both the convenience regarding the assembling process of the LED tube lamp 50 and the robustness regarding the assembled LED tube lamp 50. Several LED light sources 202 are disposed on the bendable circuit sheet 205 of the LED light strip 200, and the power supply 400 is disposed in one of the end caps 300. The LED light sources 202 and the power supply 400 can be electrically connected to each other directly via the bendable circuit sheet 205 of the LED light strip 200. Middle part of the bendable circuit sheet 205 can be mounted on the inner surface 100*a* of the glass tube 100. Instead, at least one of the two opposite, short edges of the bendable circuit sheet 205 is not mounted on the inner surface 100*a* of the glass tube 100 and may be formed as a freely extending end portion 210. The freely extending end portions 210 extends outside the glass tube 100 through one of two opposite ends of the glass tube 100 along the axial direction of the glass tube 100. The freely extending end portion 210 can extend into the end caps 300 and can be electrically connected to the power supply 400 directly. The power supply 400 may be in the form of a single integrated unit (e.g., with all components of the power supply 400 are within a body) disposed in an end cap 300 at one end of the glass tube 100. Alternatively, the power supply 400 may be in form of two separate parts (e.g., with the components of the power supply 400 are separated into two pieces) respectively disposed in two end caps 300. The power supply may supply or provide power from external signal(s), such as from an AC power line or from a ballast, to an LED module and the LED light sources. Each of the end caps 300 includes a pair of hollow conductive pins 310 utilized for being connected to an outer electrical power source. When the LED tube lamp 50 is installed to a lamp base, the hollow conductive pins 310 are plugged into corresponding conductive sockets of the lamp base such that the LED tube lamp 50 can be electrically connected to the lamp base.

In one embodiment, the LED light strip 200 comprises a bendable circuit sheet 205 which includes a wiring layer and a dielectric layer that are in a stacked arrangement, wherein the wiring layer and the dielectric layer have same area or the wiring layer has a bit less area (not shown) than the dielectric layer. The LED light source 202 is disposed on a surface of the wiring layer away from the dielectric layer. In other words, the dielectric layer is disposed on the wiring layer away from the LED light sources 202. The wiring layer is electrically connected to the power supply 400 to carry direct current (DC) signals. Meanwhile, an adhesive sheet is disposed on a surface of the dielectric layer away from the wiring layer to bond and to fix the dielectric layer to the inner circumferential surface of the glass tube 100. The wiring layer can be a metal layer serving as a power supply layer, or can be bonding wires such as copper wire. In an alternative embodiment, the LED light strip 200 further includes a circuit protection layer (not shown) cover each outer surface of the wiring layer and the dielectric layer. In another alternative embodiment, the dielectric layer can be omitted, in which the wiring layer is directly bonded to the inner circumferential surface of the glass tube 100. The circuit protection layer can be an ink material, possessing functions as solder resist and optical reflectance. Alternatively, the bendable circuit sheet 205 is a one-layered structure which is consist of one wiring layer only, and then the surface of the wiring layer is covered with a circuit protection layer of ink material as mentioned above, wherein an opening is configured over the circuit protection layer to electrically connect the LED light source 202 with the wiring layer. Whether the wiring layer has a one-layered, or two-layered structure, the circuit protective layer can be adopted. The circuit protection layer can be disposed on the side/surface of the LED light strip 200, such as the same surface of the wiring layer which has the LED light source 202 disposed thereon.

It should be noted that, in the present embodiment, the bendable circuit sheet 205 is a one-layered structure made of just one layer of the wiring layer, or a two-layered structure (made of one layer of the wiring layer and one layer of the dielectric layer), and thus would be more bendable or flexible to curl than the conventional three-layered flexible substrate. As a result, the bendable circuit sheet 205 (the LED light strip 200) of the present embodiment can be installed in a glass tube 100 that is of a customized shape or non-linear shape, and the bendable circuit sheet 205 can be mounted touching the sidewall of the glass tube 100. The bendable circuit sheet 205 mounted closely to the inner surface of the tube wall is one preferred configuration, and the fewer number of layers thereof, the better the heat dissipation effect, and the lower the material cost. Of course, the bendable circuit sheet 205 is not limited to being a one-layered or two-layered structure only; in other embodiments, the bendable circuit sheet 205 can include multiple layers of the wiring layers and multiple layers of the dielectric layers, in which the dielectric layers and the wiring layers are sequentially stacked in a staggered manner, respectively, to be disposed on the surface of the one wiring layer that is opposite from the surface of the one wiring layer which has the LED light source 202 disposed thereon.

In one embodiment, the LED light strip 200 includes a bendable circuit sheet 205 having in sequence a first wiring layer, a dielectric layer, and a second wiring layer (not shown). The thickness of the second wiring layer is greater than that of the first wiring layer, and/or the projected length of the LED light strip 200 is greater than that of the glass tube 100. The end region of the light strip 200 extending beyond the end portion of the glass tube 100 without disposition of the LED light source 202 is formed with two separate through holes to respectively electrically communicate the first wiring layer and the second wiring layer (not shown). The through holes are not communicated to each other to avoid short.

In this way, the greater thickness of the second wiring layer allows the second wiring layer to support the first wiring layer and the dielectric layer, and meanwhile allow the LED light strip 200 to be mounted onto the inner circumferential surface without being liable to shift or deform, and thus the yield rate of product can be improved. In addition, the first wiring layer and the second wiring layer are in electrical communication such that the circuit layout of the first wiring layer can be extended downward to the second wiring layer to reach the circuit layout of the entire LED light strip 200. In some circumstances, the first wiring layer connects the anode and the second wiring layer connects the cathode. Moreover, since the land for the circuit layout becomes two-layered, the area of each single layer and therefore the width of the LED light strip 200 can be reduced such that more LED light strips 200 can be put on a production line to increase productivity. Furthermore, the first wiring layer and the second wiring layer of the end region of the LED light strip 200 that extends beyond the end portion of the tube 100 without disposition of the LED light source 202 can be used to accomplish the circuit layout of a power supply 400 so that the power supply 400 can be directly disposed on the bendable circuit sheet 205 of the LED light strip 200.

In another embodiment, the projected length of the bendable circuit sheet 205 as the LED light strip 200 in a longitudinal projection is larger than the length of the glass tube 100. The LED light source 202 is disposed on the uppermost layer of the wiring layers, and is electrically connected to the power supply 400 through the (uppermost) wiring layer. Furthermore, the inner peripheral surface of the glass tube 100 or the outer circumferential surface thereof is covered with an adhesive film (not shown), for the sake of isolating the inner content from outside content of the glass tube 100 after the glass tube 100 has been ruptured. The present embodiment has the adhesive film coated on the inner peripheral surface of the glass tube 100 (not shown).

Moreover, in some embodiments, the projected length of the bendable circuit sheet is greater than the length of the glass tube 100 (not including the length of the two end caps 300 respectively connected to two ends of the glass tube 100), or at least greater than a central portion of the glass tube 100 between two transition regions (e.g., where the circumference of the tube narrows) on either end. In one embodiment, the longitudinally projected length of the bendable circuit sheet as the LED light strip 200 is larger than the length of the glass tube 100.

As shown in FIG. 3, the glass tube 100 includes a main body region 102, two rear end regions 101, and two two-arc-shaped transition regions 103 narrowed down or tapering smoothly and continuously from the main body region to the rear end regions connecting the main body region 102 and the rear end regions 101. In other words, in the transition regions 103, the glass tube 100 narrows, or tapers to have a smaller diameter when moving along the length of the glass tube 100 from the main body region 102 to the rear end regions 101. The tapering/narrowing may occur in a continuous, smooth manner (e.g., to be a smooth curve without any linear angles). By avoiding angles, in particular any acute angles, the glass tube 100 is less likely to break or crack under pressure. Furthermore, the transition region 103 is formed by two curves at both ends, wherein one curve is toward inside of the glass tube 100 and the other curve is toward outside of the glass tube 100. For example, one curve closer to the main body region 102 is convex from the perspective of an inside of the glass tube 100 and one curve closer to the rear end region 101 is concave from the perspective of an inside of the glass tube 100. The transition region 103 of the glass tube 100 in one embodiment includes only smooth curves, and does not include any angled surface portions. The outer diameter of the rear end region 101 is smaller than that of the main body region 102. Therefore, a height difference between the rear end region 101 and the main body region 102 is formed to avoid adhesives applied on the rear end region 101 being overflowed onto the main body region 102, and thereby saves manpower for removing the overflowed adhesive and increases productivity.

In one embodiment, at least part of the inner surface 100*a* of the glass tube 100 has a rough surface and the roughness of the inner surface 100*a* is higher than that of the outer surface 100*b*, such that the light from the LED light sources 202 can be uniformly spread when transmitting through the glass tube 100. Since LED light sources 202 consists of several point light sources (LED dies), each LED light source 202 casts a cone of light, which results in non-uniformity of light output intensity. With the rough surface, the light from LED light sources 202 will be diffused before transmitting through the glass tube 100 and the uniformity of light output is improved thereby. In one embodiment, the roughness of the inner surface 100*a* may be substantially from 0.1 to 40 μm, the light from LED light sources 202 will be well diffused before entirely transmitting through the glass tube 100 and the uniformity of light output is substantially improved. However, in some embodiments, the inner surface 100*a* of the glass tube 100 does not have the roughness surface.

Figure 4:
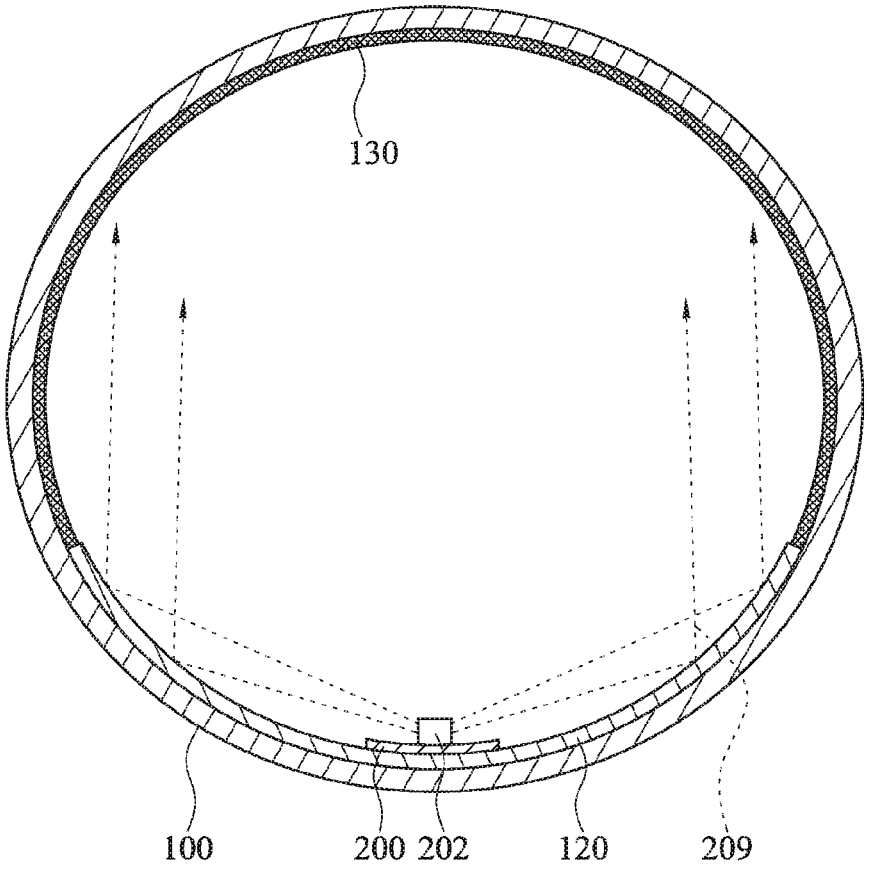
FIG. 4 illustrates a part of cross section of FIG. 2 along line B-B'.

In one embodiment, as shown in FIG. 4, the rough surface may be formed with a light scattering region 130. Since LED light sources 202 consists of several point light sources (LED dies), each LED light source 202 casts a cone of light, which results in non-uniformity of light output intensity. With the light scattering region 130, the light from LED light sources 202 will be scattered before entirely transmitting through the glass tube 100 and the uniformity of light output is substantially improved.

In one embodiment, as shown in FIG. 4, the glass tube 100 may further include a reflective film 120 disposed on a part of the inner surface 100*a* of the glass tube 100. In some embodiments, the reflective film 120 may be positioned on two sides of the LED light strip 200. As shown in FIG. 4, part of light 209 from LED light sources 202 are reflected by the reflective films 120 such that the light 209 from the LED light sources 202 can be centralized to a determined direction. And, in some embodiment, a ratio of a length of the reflective film 120 disposed on the inner surface 100*a* of the glass tube 100 extending along the circumferential direction of the glass tube 100 to a circumferential length of the glass tube 100 may be about 0.3 to 0.5, which means about 30% to 50% of the inner surface area may be covered by the reflective film 120. The reflective film 120 may be made of PET with some refractive materials such as strontium phosphate or barium sulfate or any combination thereof, with a thickness between about 140 μm and about 350 μm or between about 150 μm and about 220 μm for a more preferred effect in some embodiments. In some embodiments, only the part of the inner surface 100*a* which is not covered by the reflective film 120 is formed with the light scattering region 130 as shown in FIG. 4. In other words, the reflective film 120 is disposed on a part of the inner surface 100*a* of the glass tube 100 which is not formed with the rough surface or the light scattering region 130.

Figure 5:
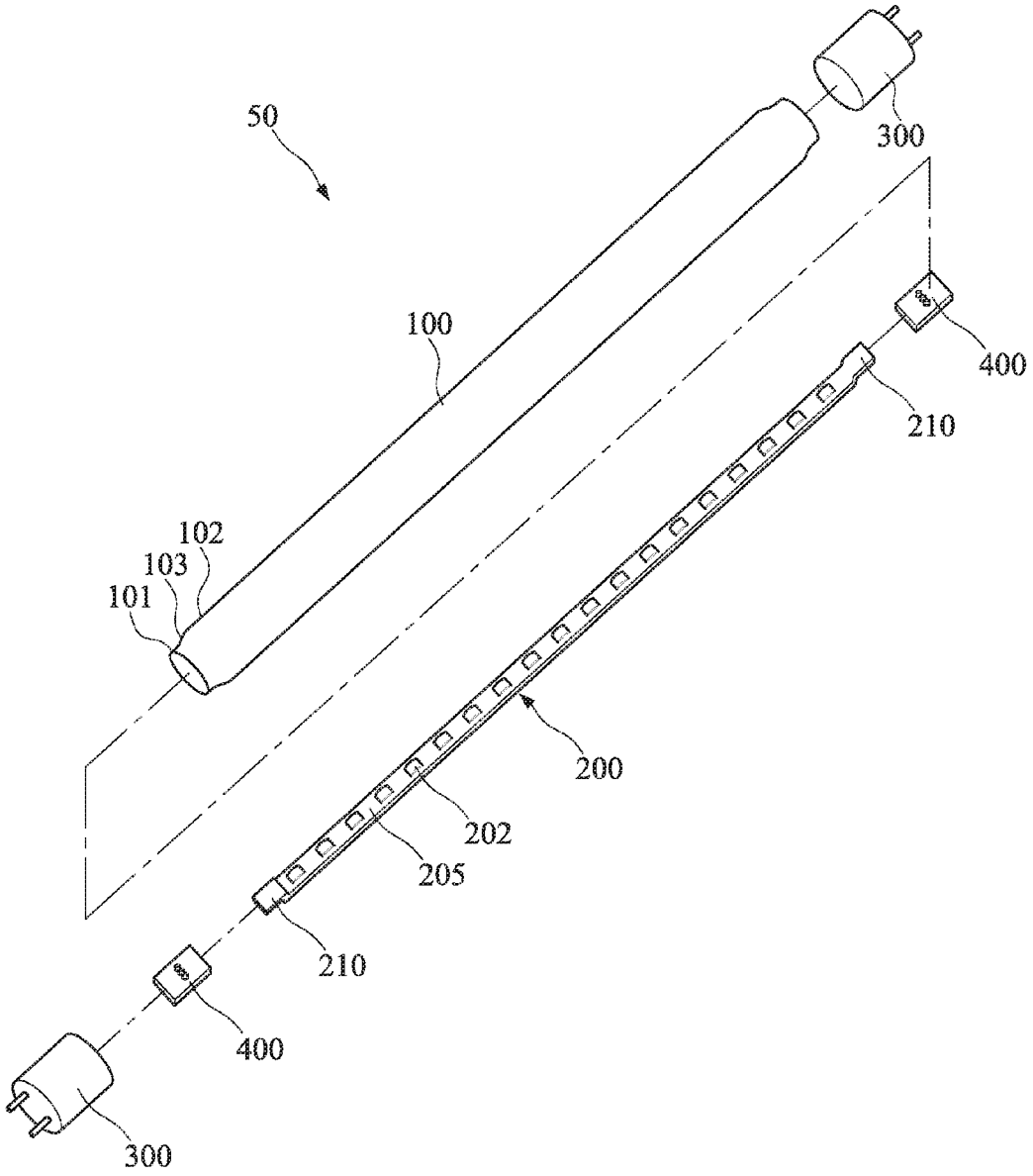
FIG. 5 illustrates an exploded view of an LED tube lamp including two parts of a power supply according to an embodiment of the instant disclosure.

In one embodiment, as shown in FIG. 5, two opposite, short edges of the bendable circuit sheet 205 may be formed as two freely extending end portions 210, and two parts of a power supply 400 are respectively disposed in the two end caps 300. The two freely extending end portions 210 respectively extends outside the glass tube 100 through two opposite ends of the glass tube 100 along the axial direction of the glass tube 100, such that can respectively extend into the two end caps 300 and be respectively electrically connected to the two parts of a power supply 400 directly.

Figure 6:
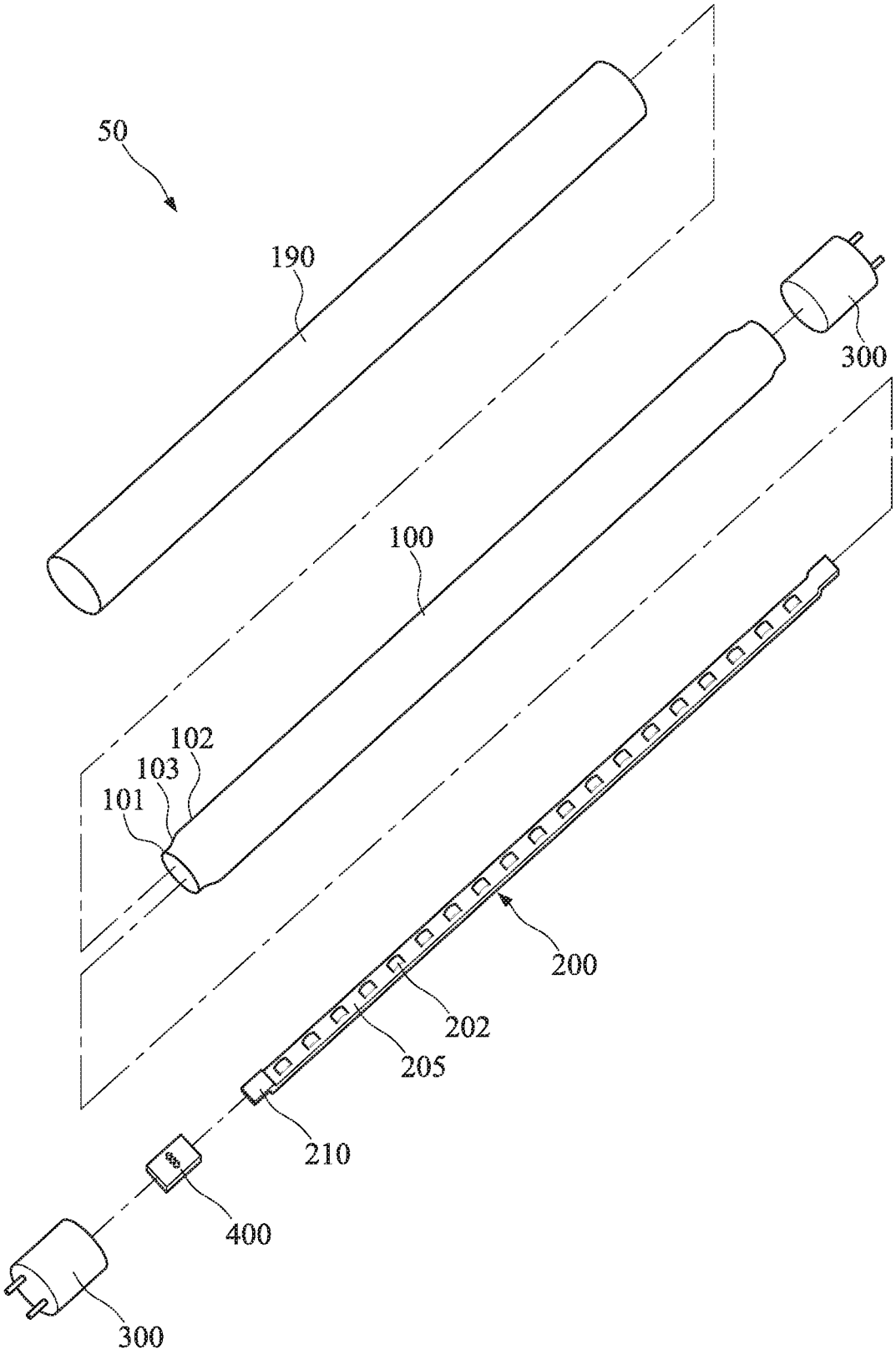
FIG. 6 illustrates an exploded view of an LED tube lamp including a heat shrink sleeve according to an embodiment of the instant disclosure.
Figure 7:
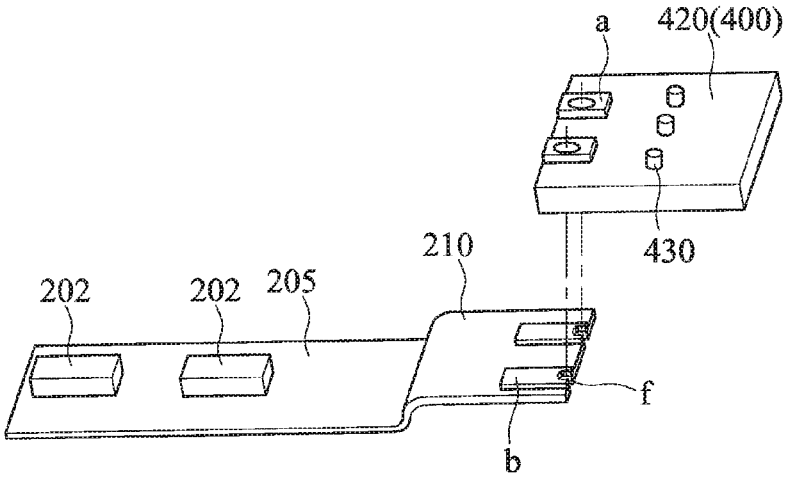
FIG. 7 illustrates a partial view of a bendable circuit sheet of an LED light strip and a power supply apart from each other according to an embodiment of the instant disclosure.
Figure 8:
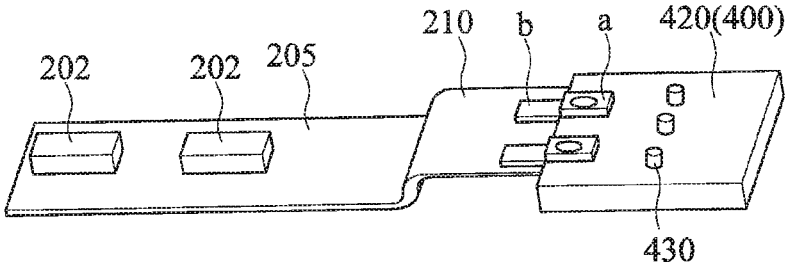
FIG. 8 illustrates a partial view of the bendable circuit sheet of the LED light strip and the power supply soldered to each other according to an embodiment of the instant disclosure.

Referring to FIG. 6, the LED tube lamp 50 may have a heat shrink sleeve 190 covering on the outer surface 100*b* of the glass tube 100. In some embodiments, the heat shrink sleeve 190 may have a thickness ranging between 20 μm and 200 μm and is substantially transparent with respect to the wavelength of light from the LED light sources 202. In some embodiments, the heat shrink sleeve 190 may be made of PFA (perfluoroalkoxy) or PTFE (polytetrafluoroethylene). The heat shrink sleeve 190 may be slightly larger than the glass tube 100, and may be shrunk and tightly cover the outer surface 100*b* of the glass tube 100 while being heated to an appropriate temperature (ex, 260° C. for PFA and PTFE).

Figure 9:
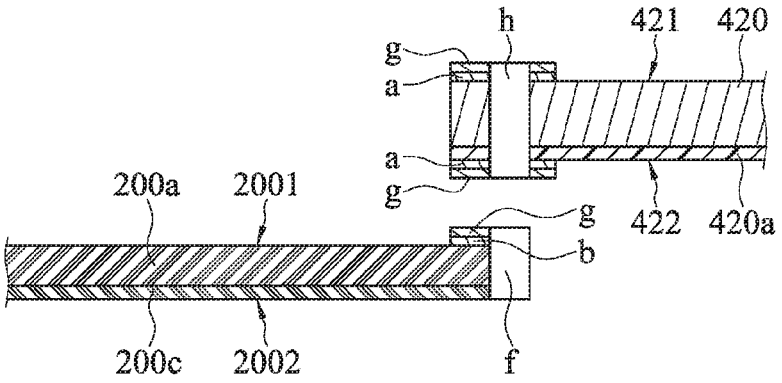
FIGS. 9 to 11 illustrate a soldering process of the bendable circuit sheet of the LED light strip and the power supply according to an embodiment of the instant disclosure.
Figure 10:
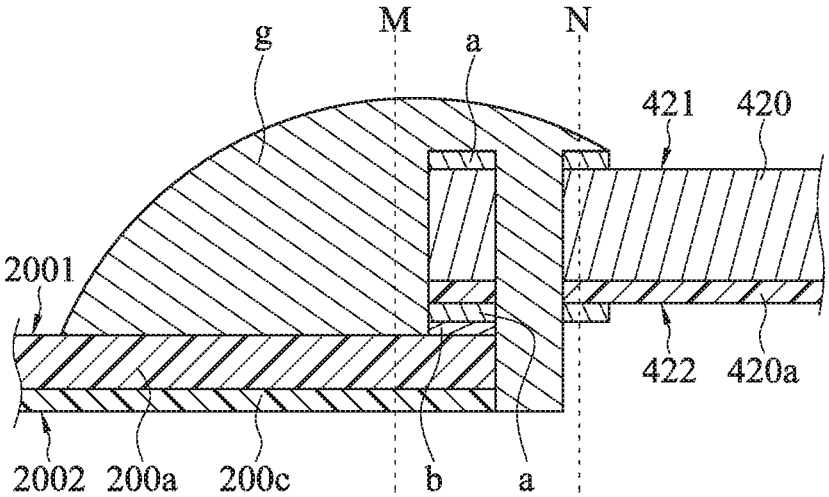
Figure 11:
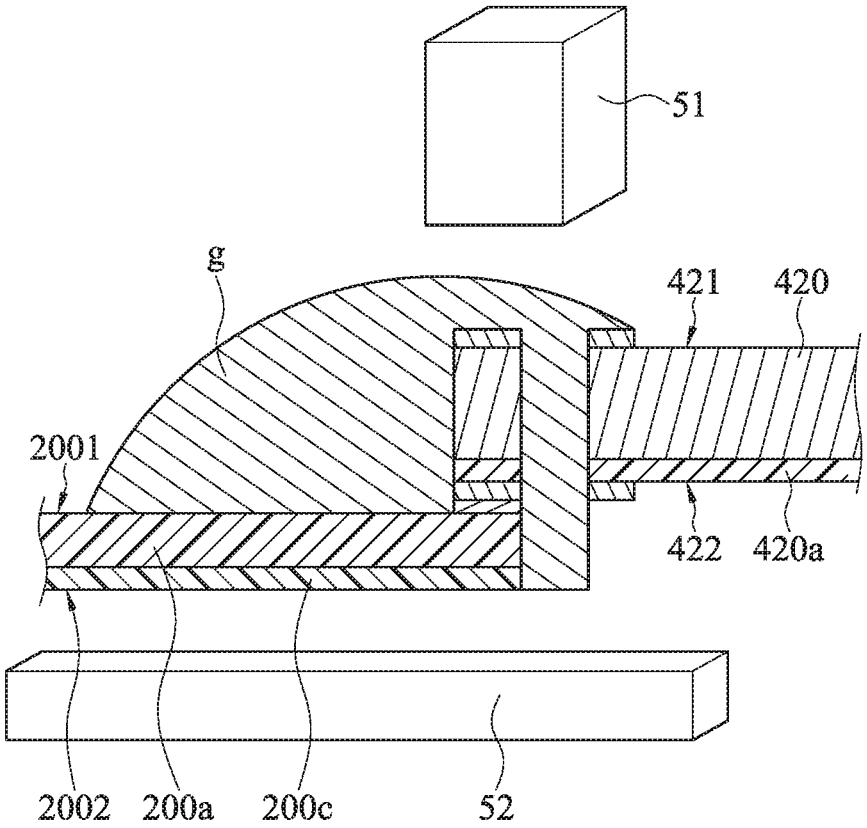

Referring to FIG. 7 to FIG. 11, FIG. 7 and FIG. 8 are respectively partial views of the bendable circuit sheet 205 of the LED light strip 200 and the printed circuit board 420 of the power supply 400 apart from and soldered to each other. FIG. 9 to FIG. 11 illustrate a soldering process of the bendable circuit sheet 205 of the LED light strip 200 and the printed circuit board 420 of the power supply 400. In the embodiment, the bendable circuit sheet 205 of the LED light strip 200 and the freely extending end portions 210 have the same structure. In some embodiments, the power supply 400 includes at least one electronic component 430 disposed on one side of the printed circuit board 420, and the freely extending end portion 210 is electrically connected to the printed circuit board 420 directly through the other side which has no electronic component 430 disposed thereon. The freely extending end portions 210 are the portions of two opposite ends of the bendable circuit sheet 205 of the LED light strip 200 and are utilized for being connected to the printed circuit board 420 of the power supply 400. The LED light strip 200 and the power supply 400 can be electrically connected to each other by soldering. Two opposite ends of the bendable circuit sheet 205 of the LED light strip 200 are utilized for being respectively soldered directly to the printed circuit board 420 of the two parts of a power supply 400. In other embodiments, only one end of the bendable circuit sheet 205 of the LED light strip 200 is soldered directly to the printed circuit board 420 of the power supply 400. The bendable circuit sheet 205 of the LED light strip 200 includes a circuit layer 200*a* and a circuit protecting layer 200*c* over a side of the circuit layer 200*a*. Moreover, the bendable circuit sheet 205 of the LED light strip 200 includes two opposite surfaces which are a first surface 2001 and a second surface 2002. The first surface 2001 is the one on the circuit layer 200*a* and away from the circuit protecting layer 200*c*. The second surface 2002 is the other one on the circuit protecting layer 200*c* and away from the circuit layer 200*a*. Several LED light sources 202 are disposed on the first surface 2001 and are electrically connected to circuits of the circuit layer 200*a*. The circuit protecting layer 200*c* has less electrical and thermal conductivity but being beneficial to protect the circuits. The first surface 2001 of the bendable circuit sheet 205 of the LED light strip 200 includes soldering pads "b". Soldering material "g" can be placed on the soldering pads "b". In the embodiment, the LED light strip 200 further includes a notch "f". The notch "f" is disposed on an edge of the end of the bendable circuit sheet 205 of the LED light strip 200 soldered directly to the printed circuit board 420 of the power supply 400. The printed circuit board 420 includes a power circuit layer 420*a* and soldering pads "a". Moreover, the printed circuit board 420 includes two opposite surfaces which are a first surface 421 and a second surface 422. The second surface 422 is the one on the power circuit layer 420*a*. The soldering pads "a" are respectively disposed on the first surface 421 and the second surface 422. The soldering pads "a" on the first surface 421 are corresponding to those on the second surface 422. Soldering material "g" can be placed on the soldering pad "a". In the embodiment, considering the stability of soldering and the optimization of automatic process, the bendable circuit sheet 205 of LED light strip 200 is disposed below the printed circuit board 420 (the direction is referred to FIG. 9). That is to say, the first surface 2001 of the bendable circuit sheet 205 of the LED light strip 200 is connected to the second surface 422 of the printed circuit board 420 of the power supply 400.

As shown in FIG. 10 and FIG. 11, in the soldering process of the bendable circuit sheet 205 of the LED light strip 200 and the printed circuit board 420 of the power supply 400, the circuit protecting layer 200*c* of the bendable circuit sheet 205 of the LED light strip 200 is placed on a supporting table 52 (i.e., the second surface 2002 of the bendable circuit sheet 205 of the LED light strip 200 contacts the supporting table 52) in advance. The soldering pads "a" on the second surface 422 of the printed circuit board 420 of the power supply 400 directly sufficiently contact the soldering pads "b" on the first surface 2001 of the bendable circuit sheet 205 of the LED light strip 200. A thermo-compression heating head 51 presses on a portion where the bendable circuit sheet 205 of the LED light strip 200 and the printed circuit board 420 of the power supply 400 are soldered to each other. When soldering, the soldering pads "b" on the first surface 2001 of the bendable circuit sheet 205 of the LED light strip 200 contact the soldering pads "a" on the second surface 422 of the printed circuit board 420 of the power supply 400, and the soldering pads "a" on the first surface 421 of the printed circuit board 420 of the power supply 400 contact the thermo-compression heating head 51. Under the circumstances, the heat from the soldering thermo-compression heating head 51 can directly transmit through the soldering pads "a" on the first surface 421 of the printed circuit board 420 of the power supply 400 and the soldering pads "a" on the second surface 422 of the printed circuit board 420 of the power supply 400 to the soldering pads "b" on the first surface 2001 of the bendable circuit sheet 205 of the LED light strip 200. The transmission of the heat between the thermo-compression heating head 51 and the soldering pads "a" and b is not likely to be affected by the circuit protecting layer 200*c* which has relatively less thermal conductivity, and, consequently, the efficiency and stability regarding the connections and soldering process of the soldering pads "a" and "b" of the printed circuit board 420 of the power supply 400 and the bendable circuit sheet 205 of the LED light strip 200 can be improved. As shown in FIG. 10, the printed circuit board 420 of the power supply 400 and the bendable circuit sheet 205 of the LED light strip 200 are firmly connected to each other by the soldering material "g". Components between the virtual line M and the virtual line N of FIG. 10 from top to bottom are the soldering pads "a" on the first surface 421 of printed circuit board 420, the printed circuit board 420, the power circuit layer 420*a*, the soldering pads "a" on the second surface 422 of printed circuit board 420, the soldering pads "b" on the first surface 2001 of the bendable circuit sheet 205 of the LED light strip 200, the circuit layer 200*a* of the bendable circuit sheet 205 of the LED light strip 200, and the circuit protecting layer 200*c* of the bendable circuit sheet 205 of the LED light strip 200. The connection of the printed circuit board 420 of the power supply 400 and the bendable circuit sheet 205 of LED light strip 200 are firm and stable.

In other embodiments, an additional circuit protecting layer can be disposed over the first surface 2001 of the circuit layer 200*a*. In other words, the circuit layer 200*a* is sandwiched between two circuit protecting layers, and therefore the first surface 2001 of the circuit layer 200*a* can be protected by the circuit protecting layer. A part of the circuit layer 200*a* (the part having the soldering pads "b") is exposed for being connected to the soldering pads "a" of the printed circuit board 420 of the power supply 400. Under the circumstances, a part of the bottom of the LED light source 202 contacts the circuit protecting layer on the first surface 2001 of the circuit layer 200*a*, and the other part of the bottom of the LED light source 202 contacts the circuit layer 200*a*.

In addition, according to the embodiment shown in FIG. 7 to FIG. 11, the printed circuit board 420 of the power supply 400 further includes through holes "h" passing through the soldering pads "a". In an automatic soldering process, when the thermo-compression heating head 51 automatically presses the printed circuit board 420 of the power supply 400, the soldering material "g" on the soldering pads "a" can be pushed into the through holes "h" by the thermo-compression heating head 51 accordingly, which fits the needs of automatic process.

Figure 12:
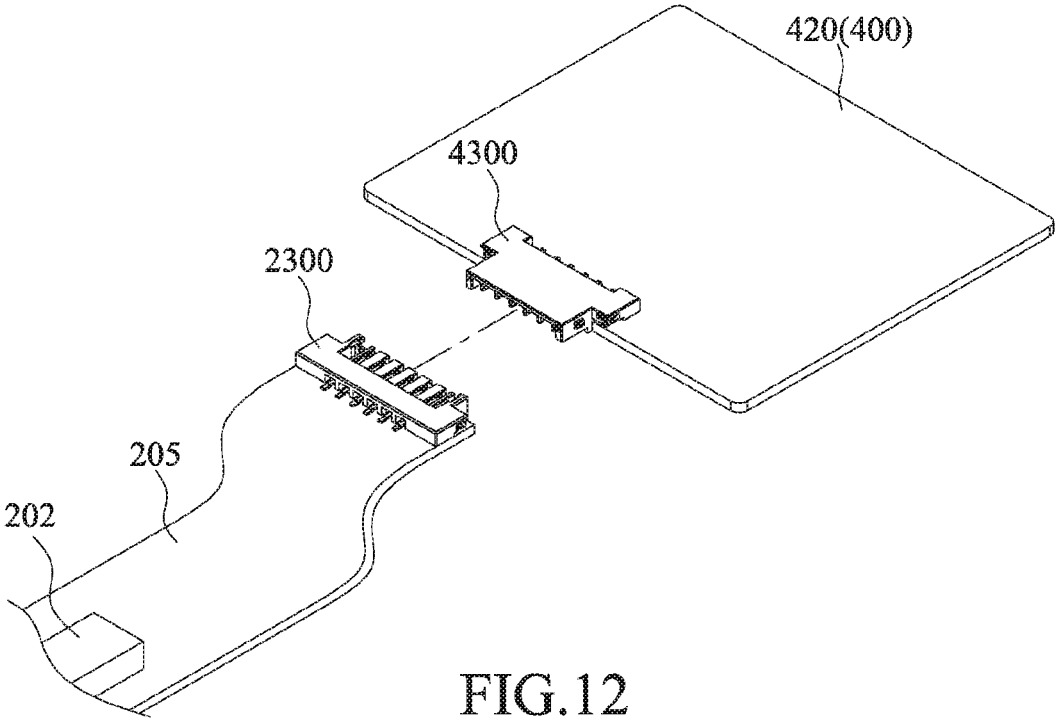
FIGS. 12 and 13 illustrate a bendable circuit sheet of an LED light strip and a power supply electrically connected to each other by a pair of jack/plug connectors according to an embodiment of the instant disclosure.
Figure 13:
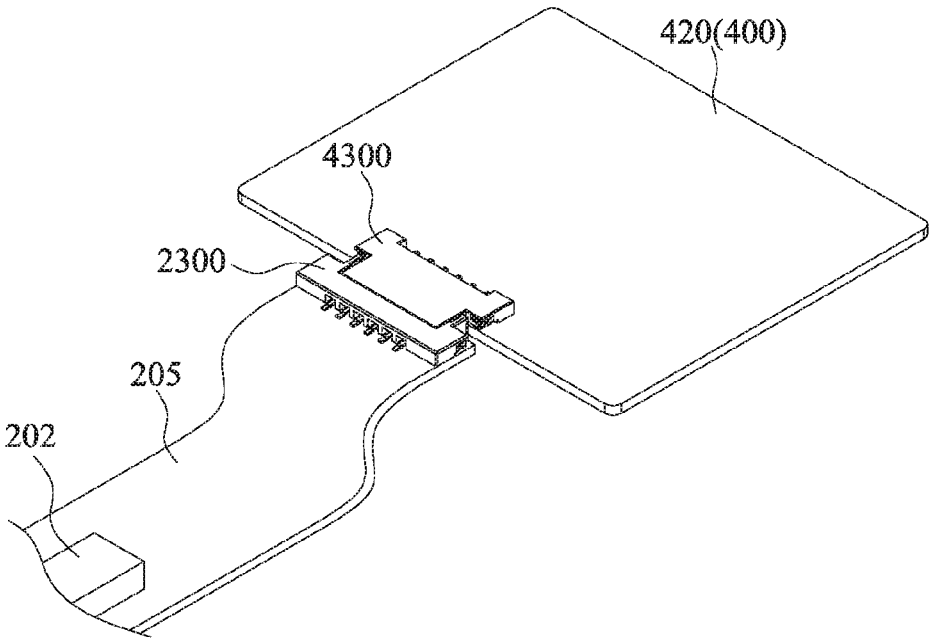

Referring to FIG. 12 and FIG. 13, in some embodiments, the bendable circuit sheet 205 of the LED light strip 200 and the printed circuit board 420 of the power supply 400 are electrically connected to each other by a pair of jack/plug connectors rather than by soldering. As shown in FIG. 12, the freely extending end portion 210 of the bendable circuit sheet 205 of the LED light strip 200 has a first electric connector 2300, and the printed circuit board 420 of the power supply 400 has a second electric connector 4300 which is capable of being connected with the first connector 2300. Since the LED light strip 200 and the power supply 400 are electrically connected to each other by a pair of jack/plug connectors rather than by soldering, the end cap 300 and the power supply 400 can be replaceable.

Figure 14:
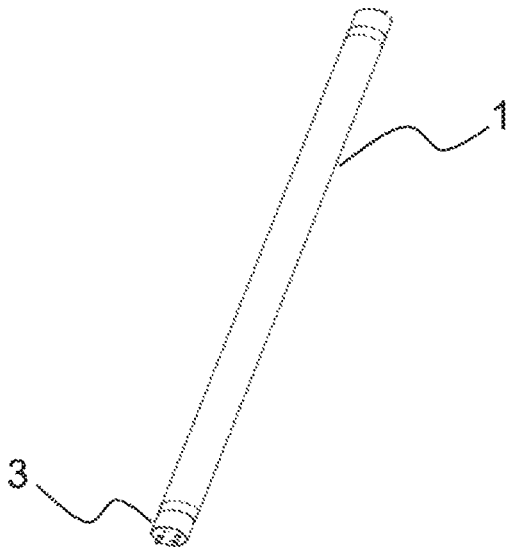
FIG. 14 is a perspective view schematically illustrating an LED tube lamp according to an embodiment of the instant disclosure.
Figure 15:
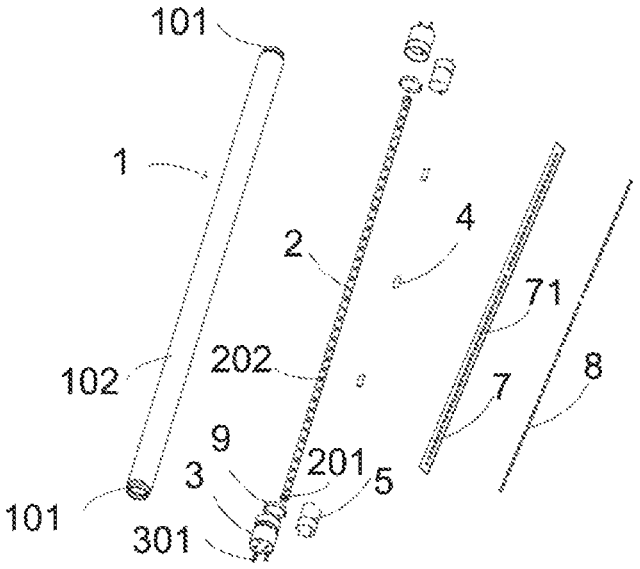
FIG. 15 an exemplary exploded view schematically illustrating the LED tube lamp shown in FIG. 14.

Referring to FIGS. 14 and 15, an LED tube lamp of one embodiment of the present invention includes a glass tube 1, an LED light strip 2 disposed inside the glass tube 1, and two end caps 3 respectively disposed at two ends of the glass tube 1.

Figure 16:
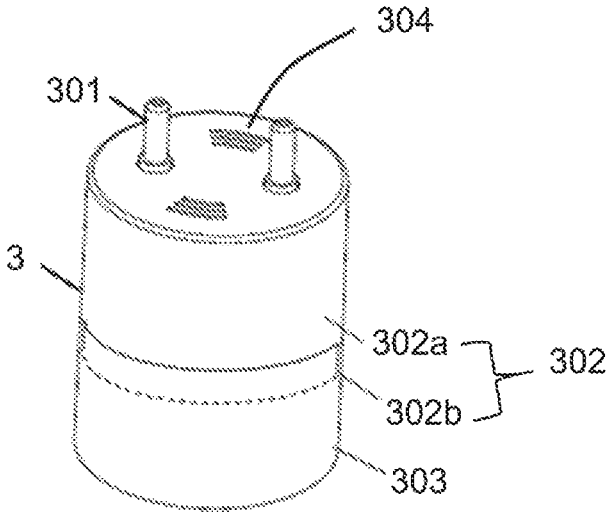
FIG. 16 is a perspective view schematically illustrating front and top of an end cap of the LED tube lamp according to one embodiment of the instant disclosure.

Referring to FIGS. 15 and 16, in one embodiment, the end cap 3 may have openings 304 to dissipate heat generated by the power supply modules inside the end cap 3 so as to prevent a high temperature condition inside the end cap 3 that might reduce reliability. In some embodiments, the openings 304 are in a shape of an arc; especially in a shape of three arcs with different size. In one embodiment, the openings 304 are in a shape of three arcs with gradually varying size. The openings 304 on the end cap 3 can be in any one of the above-mentioned shape or any combination thereof. At least a part of the openings are arranged along an arc and spaced apart from each other.

Referring to FIGS. 16, in one embodiment, each end cap 3 includes an electrically insulating tube 302, a thermal conductive member 303 sleeving over the electrically insulating tube 302, and two hollow conductive pins 301 disposed on the electrically insulating tube 302. The thermal conductive member 303 can be a metal ring that is tubular in shape. According to FIGS. 15 and 16, the openings 304 on the electrically insulating tube symmetric to each other with respect to a vertical central plane passing through the middle of a line connecting the two conductive pins 301 and the vertical central plane is perpendicular to the line connecting the two conductive pins 301. The openings 304 are on a surface of the electrically insulating tube 302 on which the two conductive pins 301 are disposed.

The openings 304 symmetrically disposed on the electrically insulating tube 302 is capable of efficiently dissipating heat generated during the heating and solidification of the hot melt adhesive. Specifically, during heating and solidification of the hot melt adhesive, the hot melt adhesive circularly surrounding the end portions of the glass tube 100 will be heated and generates heat which is circularly surrounding the glass tube 100. Since the holes 304 are symmetrically arranged on the electrically insulating tube 302, the heat could be efficiently dissipated through the opening 304 which is the closest to the heat-generating sources (hot melt adhesive). In addition, the holes 304 may be used to dissipate heat generated by power supply 400 during the use of the LED tube lamp 50. In one embodiment, the components of the power supply 400 may be arranged symmetrically in one of the end caps, separately in both of the end caps, or in the glass tube 100 in accordance with the symmetrical arrangement of the holes 304. Accordingly, the heat generated from the components of the power supply can be dissipated through the hole 301 which is the closest to the component.

Accordingly, the heat generated from the components of the power supply 400 can be dissipated through the hole 301 which is the closest to the component.

Next, examples of the circuit design and using of the power supply (module) 400 (or 5 in FIG. 15) are described as follows.

Figure 17A:
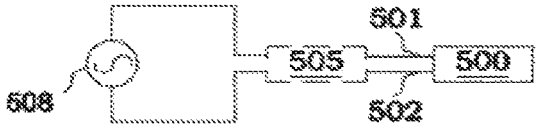
FIG. 17A is a block diagram of an exemplary power supply module 400 in an LED tube lamp according to some embodiments of the present invention.

FIG. 17A is a block diagram of a power supply module or power supply 400 in an LED tube lamp according to an embodiment of the present invention. Referring to FIG. 17A, an AC power supply 508 is used to supply an AC supply signal, and may be an AC powerline with a voltage rating, for example, in 100-277 volts and a frequency rating, for example, of 50 or 60 Hz. A lamp driving circuit 505 receives and then converts the AC supply signal into an AC driving signal as an external driving signal. Lamp driving circuit 505 may be for example an electronic ballast used to convert the AC powerline into a high-frequency high-voltage AC driving signal. Common types of electronic ballast include instant-start ballast, program-start or rapid-start ballast, etc., which may all be applicable to the LED tube lamp of the present invention. The voltage of the AC driving signal is likely higher than 300 volts, and is in some embodiments in the range of about 400-700 volts. The frequency of the AC driving signal is likely higher than 10 k Hz, and is in some embodiments in the range of about 20 k-50 k Hz. The LED tube lamp 500 receives an external driving signal and is thus driven to emit light. In one embodiment, the external driving signal comprises the AC driving signal from lamp driving circuit 505. In one embodiment, LED tube lamp 500 is in a driving environment in which it is power-supplied at its one end cap having two conductive pins 501 and 502, which are coupled to lamp driving circuit 505 to receive the AC driving signal. The two conductive pins 501 and 502 may be electrically connected to, either directly or indirectly, the lamp driving circuit 505.

It is worth noting that lamp driving circuit 505 may be omitted and is therefore depicted by a dotted line. In one embodiment, if lamp driving circuit 505 is omitted, AC power supply 508 is directly connected to pins 501 and 502, which then receive the AC supply signal as an external driving signal.

Figure 17B:
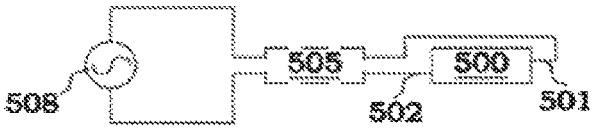
FIG. 17B is a block diagram of an exemplary power supply module 400 in an LED tube lamp according to some embodiments of the present invention.

In addition to the above use with a single-end power supply, LED tube lamp 500 may instead be used with a dual-end power supply to one pin at each of the two ends of an LED lamp tube. FIG. 17B is a block diagram of a power supply module 400 in an LED tube lamp according to one embodiment of the present invention. Referring to FIG. 17B, compared to that shown in FIG. 17A, pins 501 and 502 are respectively disposed at the two opposite end caps of LED tube lamp 500, forming a single pin at each end of LED tube lamp 500, with other components and their functions being the same as those in FIG. 17A.

Figure 17C:
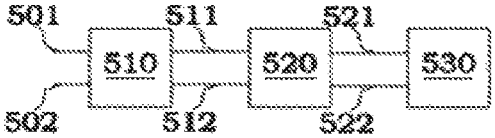
FIG. 17C is a block diagram of an exemplary LED lamp according to some embodiments of the present invention.

FIG. 17C is a block diagram of an LED lamp according to one embodiment of the present invention. Referring to FIG. 17C, the power supply module of the LED lamp summarily includes a rectifying circuit 510, a filtering circuit 520, and an LED driving module 530. Rectifying circuit 510 is coupled to pins 501 and 502 to receive and then rectify an external driving signal, so as to output a rectified signal at output terminals 511 and 512. The external driving signal may be the AC driving signal or the AC supply signal described with reference to FIGS. 17A and 17B, or may even be a DC signal, which embodiments do not alter the LED lamp of the present invention. Filtering circuit 520 is coupled to the first rectifying circuit for filtering the rectified signal to produce a filtered signal, as recited in the claims. For instance, filtering circuit 520 is coupled to terminals 511 and 512 to receive and then filter the rectified signal, so as to output a filtered signal at output terminals 521 and 522. LED driving module 530 is coupled to filtering circuit 520, to receive the filtered signal for emitting light. For instance, LED driving module 530 may be a circuit coupled to terminals 521 and 522 to receive the filtered signal and thereby to drive an LED unit (not shown) in LED driving module 530 to emit light. Details of these operations are described in below descriptions of certain embodiments.

It is worth noting that although there are two output terminals 511 and 512 and two output terminals 521 and 522 in embodiments of these Figs., in practice the number of ports or terminals for coupling between rectifying circuit 510, filtering circuit 520, and LED driving module 530 may be one or more depending on the needs of signal transmission between the circuits or devices.

In addition, the power supply module of the LED lamp described in FIG. 17C, and embodiments of the power supply module of an LED lamp described below, may each be used in the LED tube lamp 500 in FIGS. 17A and 17B, and may instead be used in any other type of LED lighting structure having two conductive pins used to conduct power, such as LED light bulbs, personal area lights (PAL), plug-in LED lamps with different types of bases (such as types of PL-S, PL-D, PL-T, PL-L, etc.), etc.

Figure 17D:
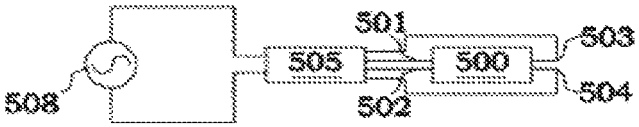
FIG. 17D is a block diagram of an exemplary power supply module 400 in an LED tube lamp according to some embodiments of the present invention.

FIG. 17D is a block diagram of a power supply module 400 in an LED tube lamp according to an embodiment of the present invention. Referring to FIG. 17D, an AC power supply 508 is used to supply an AC supply signal. A lamp driving circuit 505 receives and then converts the AC supply signal into an AC driving signal. An LED tube lamp 500 receives an AC driving signal from lamp driving circuit 505 and is thus driven to emit light. In this embodiment, LED tube lamp 500 is power-supplied at its both end caps respectively having two pins 501 and 502 and two pins 503 and 504, which are coupled to lamp driving circuit 505 to concurrently receive the AC driving signal to drive an LED unit (not shown) in LED tube lamp 500 to emit light. AC power supply 508 may be e.g. the AC powerline, and lamp driving circuit 505 may be a stabilizer or an electronic ballast.

Figure 17E:
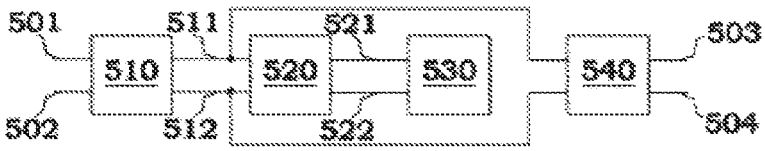
FIG. 17E is a block diagram of an LED lamp according to some embodiments of the present invention.

FIG. 17E is a block diagram of an LED lamp according to an embodiment of the present invention. Referring to FIG. 17E, the power supply module of the LED lamp summarily includes a rectifying circuit 510, a filtering circuit 520, an LED driving module 530, and a filtering circuit 540. Rectifying circuit 510 is coupled to pins 501 and 502 to receive and then rectify an external driving signal conducted by pins 501 and 502. Rectifying circuit 540 is coupled to pins 503 and 504 to receive and then rectify an external driving signal conducted by pins 503 and 504. Therefore, the power supply module of the LED lamp may include two rectifying circuits 510 and 540 configured to output a rectified signal at output terminals 511 and 512. Filtering circuit 520 is coupled to terminals 511 and 512 to receive and then filter the rectified signal, so as to output a filtered signal at output terminals 521 and 522. LED driving module 530 is coupled to terminals 521 and 522 to receive the filtered signal and thereby to drive an LED unit (not shown) in LED driving module 530 to emit light.

The power supply module of the LED lamp in this embodiment of FIG. 17E may be used in LED tube lamp 500 with a dual-end power supply in FIG. 17D. It is worth noting that since the power supply module of the LED lamp comprises rectifying circuits 510 and 540, the power supply module of the LED lamp may be used in LED tube lamp 500 with a single-end power supply in FIGS. 17A and 17B, to receive an external driving signal (such as the AC supply signal or the AC driving signal described above). The power supply module of an LED lamp in this embodiment and other embodiments herein may also be used with a DC driving signal.

Figure 18A:
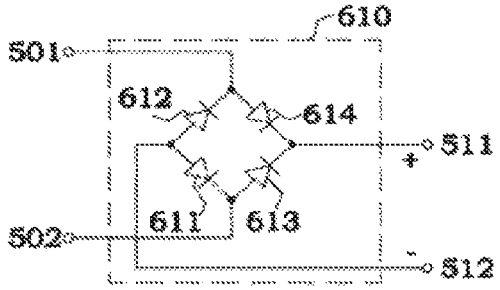
FIG. 18A is a schematic diagram of a rectifying circuit according to some embodiments of the present invention.

FIG. 18A is a schematic diagram of a rectifying circuit according to an embodiment of the present invention. Referring to FIG. 18A, rectifying circuit 610 includes rectifying diodes 611, 612, 613, and 614, configured to full-wave rectify a received signal. Diode 611 has an anode connected to output terminal 512, and a cathode connected to pin 502. Diode 612 has an anode connected to output terminal 512, and a cathode connected to pin 501. Diode 613 has an anode connected to pin 502, and a cathode connected to output terminal 511. Diode 614 has an anode connected to pin 501, and a cathode connected to output terminal 511.

When pins 501 and 502 receive an AC signal, rectifying circuit 610 operates as follows. During the connected AC signal's positive half cycle, the AC signal is input through pin 501, diode 614, and output terminal 511 in sequence, and later output through output terminal 512, diode 611, and pin 502 in sequence. During the connected AC signal's negative half cycle, the AC signal is input through pin 502, diode 613, and output terminal 511 in sequence, and later output through output terminal 512, diode 612, and pin 501 in sequence. Therefore, during the connected AC signal's full cycle, the positive pole of the rectified signal produced by rectifying circuit 610 remains at output terminal 511, and the negative pole of the rectified signal remains at output terminal 512. Accordingly, the rectified signal produced or output by rectifying circuit 610 is a full-wave rectified signal.

When pins 501 and 502 are coupled to a DC power supply to receive a DC signal, rectifying circuit 610 operates as follows. When pin 501 is coupled to the anode of the DC supply and pin 502 to the cathode of the DC supply, the DC signal is input through pin 501, diode 614, and output terminal 511 in sequence, and later output through output terminal 512, diode 611, and pin 502 in sequence. When pin 501 is coupled to the cathode of the DC supply and pin 502 to the anode of the DC supply, the DC signal is input through pin 502, diode 613, and output terminal 511 in sequence, and later output through output terminal 512, diode 612, and pin 501 in sequence. Therefore, no matter what the electrical polarity of the DC signal is between pins 501 and 502, the positive pole of the rectified signal produced by rectifying circuit 610 remains at output terminal 511, and the negative pole of the rectified signal remains at output terminal 512.

Therefore, rectifying circuit 610 in this embodiment can output or produce a proper rectified signal regardless of whether the received input signal is an AC or DC signal.

Figure 18B:
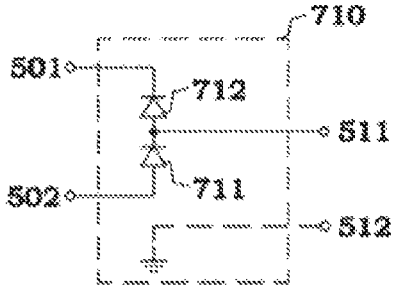
FIG. 18B is a schematic diagram of a rectifying circuit according to some embodiments of the present invention.

FIG. 18B is a schematic diagram of a rectifying circuit according to an embodiment of the present invention. Referring to FIG. 18B, rectifying circuit 710 includes rectifying diodes 711 and 712, configured to half-wave rectify a received signal. Diode 711 has an anode connected to pin 502, and a cathode connected to output terminal 511. Diode 712 has an anode connected to output terminal 511, and a cathode connected to pin 501. Output terminal 512 may be omitted or grounded depending on actual applications.

Next, exemplary operation(s) of rectifying circuit 710 is described as follows.

In one embodiment, during a received AC signal's positive half cycle, the electrical potential at pin 501 is higher than that at pin 502, so diodes 711 and 712 are both in a cutoff state as being reverse-biased, making rectifying circuit 710 not outputting a rectified signal. During a received AC signal's negative half cycle, the electrical potential at pin 501 is lower than that at pin 502, so diodes 711 and 712 are both in a conducting state as being forward-biased, allowing the AC signal to be input through diode 711 and output terminal 511, and later output through output terminal 512, a ground terminal, or another end of the LED tube lamp not directly connected to rectifying circuit 710. Accordingly, the rectified signal produced or output by rectifying circuit 710 is a half-wave rectified signal.

Figure 18C:
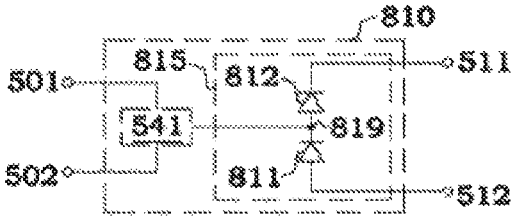
FIG. 18C is a schematic diagram of a rectifying circuit according to some embodiments of the present invention.

FIG. 18C is a schematic diagram of a rectifying circuit according to an embodiment of the present invention. Referring to FIG. 18C, rectifying circuit 810 includes a rectifying unit 815 and a terminal adapter circuit 541. In this embodiment, rectifying unit 815 comprises a half-wave rectifier circuit including diodes 811 and 812 and configured to half-wave rectify. Diode 811 has an anode connected to an output terminal 512, and a cathode connected to a half-wave node 819. Diode 812 has an anode connected to half-wave node 819, and a cathode connected to an output terminal 511. Terminal adapter circuit 541 is coupled to half-wave node 819 and pins 501 and 502, to transmit a signal received at pin 501 and/or pin 502 to half-wave node 819. By means of the terminal adapting function of terminal adapter circuit 541, rectifying circuit 810 allows of two input terminals (connected to pins 501 and 502) and two output terminals 511 and 512.

Next, in certain embodiments, rectifying circuit 810 operates as follows.

During a received AC signal's positive half cycle, the AC signal may be input through pin 501 or 502, terminal adapter circuit 541, half-wave node 819, diode 812, and output terminal 511 in sequence, and later output through another end or circuit of the LED tube lamp. During a received AC signal's negative half cycle, the AC signal may be input through another end or circuit of the LED tube lamp, and later output through output terminal 512, diode 811, half-wave node 819, terminal adapter circuit 541, and pin 501 or 502 in sequence.

It's worth noting that terminal adapter circuit 541 may comprise a resistor, a capacitor, an inductor, or any combination thereof, for performing functions of voltage/current regulation or limiting, types of protection, current/voltage regulation, etc. Descriptions of these functions are presented below.

Figure 18D:
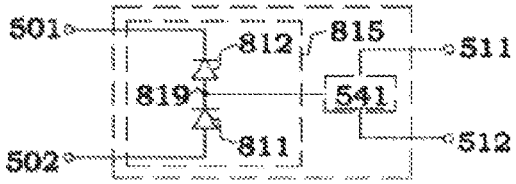
FIG. 18D is a schematic diagram of a rectifying circuit according to some embodiments of the present invention.

In practice, rectifying unit 815 and terminal adapter circuit 541 may be interchanged in position (as shown in FIG. 18D), without altering the function of half-wave rectification. FIG. 18D is a schematic diagram of a rectifying circuit according to an embodiment of the present invention. Referring to FIG. 18D, diode 811 has an anode connected to pin 502 and diode 812 has a cathode connected to pin 501. A cathode of diode 811 and an anode of diode 812 are connected to half-wave node 819. Terminal adapter circuit 541 is coupled to half-wave node 819 and output terminals 511 and 512. During a received AC signal's positive half cycle, the AC signal may be input through another end or circuit of the LED tube lamp, and later output through output terminal 512 or 512, terminal adapter circuit 541, half-wave node 819, diode 812, and pin 501 in sequence. During a received AC signal's negative half cycle, the AC signal may be input through pin 502, diode 811, half-wave node 819, terminal adapter circuit 541, and output node 511 or 512 in sequence, and later output through another end or circuit of the LED tube lamp.

It is worth noting that terminal adapter circuit 541 in embodiments shown in FIGS. 18C and 18D may be omitted and is therefore depicted by a dotted line. If terminal adapter circuit 541 of FIG. 18C is omitted, pins 501 and 502 will be coupled to half-wave node 819. If terminal adapter circuit 541 of FIG. 18D is omitted, output terminals 511 and 512 will be coupled to half-wave node 819.

Rectifying circuit 510 as shown and explained in FIGS. 18A-D can constitute or be the rectifying circuit 540 shown in FIG. 17E, as having pins 503 and 504 for conducting instead of pins 501 and 502.

Next, an explanation follows as to choosing embodiments and their combinations of rectifying circuits 510 and 540, with reference to FIGS. 17C and 17E.

Rectifying circuit 510 in embodiments shown in FIG. 17C may comprise the rectifying circuit 610 in FIG. 18A.

Rectifying circuits 510 and 540 in embodiments shown in FIG. 17E may each comprise any one of the rectifying circuits in FIGS. 18A-D, and terminal adapter circuit 541 in FIGS. 18C-D may be omitted without altering the rectification function needed in an LED tube lamp. When rectifying circuits 510 and 540 each comprise a half-wave rectifier circuit described in FIGS. 18B-D, during a received AC signal's positive or negative half cycle, the AC signal may be input from one of rectifying circuits 510 and 540, and later output from the other rectifying circuit 510 or 540. Further, when rectifying circuits 510 and 540 each comprise the rectifying circuit described in FIG. 18C or 18D, or when they comprise the rectifying circuits in FIGS. 18C and 18D respectively, only one terminal adapter circuit 541 may be needed for functions of voltage/current regulation or limiting, types of protection, current/voltage regulation, etc. within rectifying circuits 510 and 540, omitting another terminal adapter circuit 541 within rectifying circuit 510 or 540.

Figure 19A:
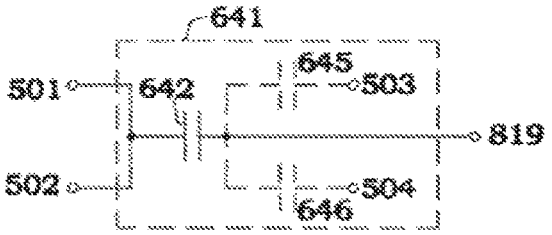
FIG. 19A is a schematic diagram of a terminal adapter circuit according to some embodiments of the present invention.

FIG. 19A is a schematic diagram of the terminal adapter circuit according to an embodiment of the present invention. Referring to FIG. 19A, terminal adapter circuit 641 comprises a capacitor 642 having an end connected to pins 501 and 502, and another end connected to half-wave node 819. Capacitor 642 has an equivalent impedance to an AC signal, which impedance increases as the frequency of the AC signal decreases, and decreases as the frequency increases. Therefore, capacitor 642 in terminal adapter circuit 641 in this embodiment works as a high-pass filter. Further, terminal adapter circuit 641 is connected in series to an LED unit in the LED tube lamp, producing an equivalent impedance of terminal adapter circuit 641 to perform a current/voltage limiting function on the LED unit, thereby preventing damaging of the LED unit by an excessive voltage across and/or current in the LED unit. In addition, choosing the value of capacitor 642 according to the frequency of the AC signal can further enhance voltage/current regulation.

It's worth noting that terminal adapter circuit 641 may further include a capacitor 645 and/or capacitor 646. Capacitor 645 has an end connected to half-wave node 819, and another end connected to pin 503. Capacitor 646 has an end connected to half-wave node 819, and another end connected to pin 504. For example, half-wave node 819 may be a common connective node between capacitors 645 and 646. And capacitor 642 acting as a current regulating capacitor is coupled to the common connective node and pins 501 and 502. In such a structure, series-connected capacitors 642 and 645 exist between one of pins 501 and 502 and pin 503, and/or series-connected capacitors 642 and 646 exist between one of pins 501 and 502 and pin 504. Through equivalent impedances of series-connected capacitors, voltages from the AC signal are divided. Referring to FIGS. 17E and 19A, according to ratios between equivalent impedances of the series-connected capacitors, the voltages respectively across capacitor 642 in rectifying circuit 510, filtering circuit 520, and LED driving module 530 can be controlled, making the current flowing through an LED module in LED driving module 530 being limited within a current rating, and then protecting/preventing filtering circuit 520 and LED driving module 530 from being damaged by excessive voltages.

Figure 19B:
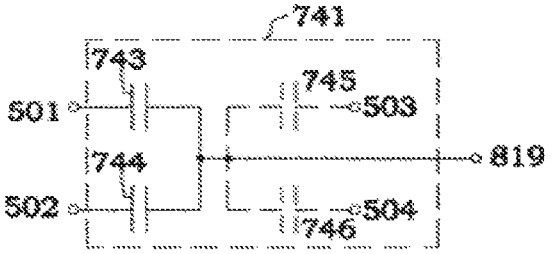
FIG. 19B is a schematic diagram of a terminal adapter circuit according to some embodiments of the present invention.

FIG. 19B is a schematic diagram of the terminal adapter circuit according to an embodiment of the present invention. Referring to FIG. 19B, terminal adapter circuit 741 comprises capacitors 743 and 744. Capacitor 743 has an end connected to pin 501, and another end connected to half-wave node 819. Capacitor 744 has an end connected to pin 502, and another end connected to half-wave node 819. Compared to terminal adapter circuit 641 in FIG. 19A, terminal adapter circuit 741 has capacitors 743 and 744 in place of capacitor 642. Capacitance values of capacitors 743 and 744 may be the same as each other, or may differ from each other depending on the magnitudes of signals to be received at pins 501 and 502.

Similarly, terminal adapter circuit 741 may further comprise a capacitor 745 and/or a capacitor 746, respectively connected to pins 503 and 504. Thus, each of pins 501 and 502 and each of pins 503 and 504 may be connected in series to a capacitor, to achieve the functions of voltage division and other protections.

Figure 19C:
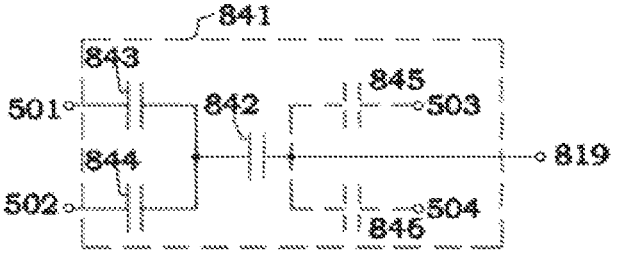
FIG. 19C is a schematic diagram of a terminal adapter circuit according to some embodiments of the present invention.

FIG. 19C is a schematic diagram of the terminal adapter circuit according to an embodiment of the present invention. Referring to FIG. 19C, terminal adapter circuit 841 comprises capacitors 842, 843, and 844. Capacitors 842 and 843 are connected in series between pin 501 and half-wave node 819. Capacitors 842 and 844 are connected in series between pin 502 and half-wave node 819. In such a circuit structure, if any one of capacitors 842, 843, and 844 is shorted, there is still at least one capacitor (of the other two capacitors) between pin 501 and half-wave node 819 and between pin 502 and half-wave node 819, which performs a current-limiting function. Therefore, in the event that a user accidentally gets an electric shock, this circuit structure will prevent an excessive current flowing through and then seriously hurting the body of the user.

Similarly, terminal adapter circuit 841 may further comprise a capacitor 845 and/or a capacitor 846, respectively connected to pins 503 and 504. Thus, each of pins 501 and 502 and each of pins 503 and 504 may be connected in series to a capacitor, to achieve the functions of voltage division and other protections.

Figure 19D:
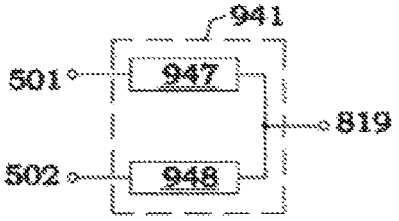
FIG. 19D is a schematic diagram of a terminal adapter circuit according to some embodiments of the present invention.

FIG. 19D is a schematic diagram of the terminal adapter circuit according to an embodiment of the present invention. Referring to FIG. 19D, terminal adapter circuit 941 comprises fuses 947 and 948. Fuse 947 has an end connected to pin 501, and another end connected to half-wave node 819. Fuse 948 has an end connected to pin 502, and another end connected to half-wave node 819. With the fuses 947 and 948, when the current through each of pins 501 and 502 exceeds a current rating of a corresponding connected fuse 947 or 948, the corresponding fuse 947 or 948 will accordingly melt and then break the circuit to achieve overcurrent protection.

Each of the embodiments of the terminal adapter circuits as in rectifying circuits 510 and 810 coupled to pins 501 and 502 and shown and explained above can be used or included in the rectifying circuit 540 shown in FIG. 17E, as when conductive pins 503 and 504 and conductive pins 501 and 502 are interchanged in position.

Capacitance values of the capacitors in the embodiments of the terminal adapter circuits shown and described above are in some embodiments in the range, for example, of about 100 pF-100 nF. Also, a capacitor used in embodiments may be equivalently replaced by two or more capacitors connected in series or parallel. For example, each of capacitors 642 and 842 may be replaced by two series-connected capacitors, one having a capacitance value chosen from the range, for example of about 1.0 nF to about 2.5 nF and which may be in some embodiments preferably 1.5 nF, and the other having a capacitance value chosen from the range, for example of about 1.5 nF to about 3.0 nF, and which is in some embodiments about 2.2 nF.

Figure 20A:
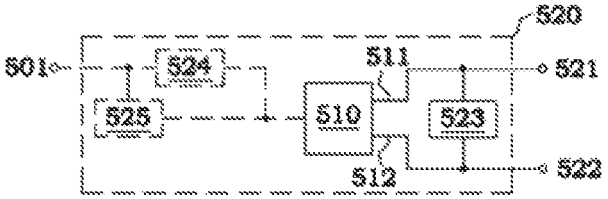
FIG. 20A is a block diagram of a filtering circuit according to some embodiments of the present invention.

FIG. 20A is a block diagram of the filtering circuit according to an embodiment of the present invention. Rectifying circuit 510 is shown in FIG. 20A for illustrating its connection with other components, without intending filtering circuit 520 to include rectifying circuit 510. Referring to FIG. 20A, filtering circuit 520 includes a filtering unit 523 coupled to rectifying output terminals 511 and 512 to receive, and to filter out ripples of, a rectified signal from rectifying circuit 510, thereby outputting a filtered signal whose waveform is smoother than the rectified signal. Filtering circuit 520 may further comprise another filtering unit 524 coupled between a rectifying circuit and a pin, which are for example rectifying circuit 510 and pin 501, rectifying circuit 510 and pin 502, rectifying circuit 540 and pin 503, or rectifying circuit 540 and pin 504. Filtering unit 524 is for filtering of a specific frequency, in order to filter out a specific frequency component of an external driving signal. In this embodiment of FIG. 20A, filtering unit 524 is coupled between rectifying circuit 510 and pin 501. Filtering circuit 520 may further comprise another filtering unit 525 coupled between one of pins 501 and 502 and a diode of rectifying circuit 510, or between one of pins 503 and 504 and a diode of rectifying circuit 540, for reducing or filtering out electromagnetic interference (EMI). In this embodiment, filtering unit 525 is coupled between pin 501 and a diode (not shown in FIG. 20A) of rectifying circuit 510. Since filtering units 524 and 525 may be present or omitted depending on actual circumstances of their uses, they are depicted by a dotted line in FIG. 20A.

Figure 20B:
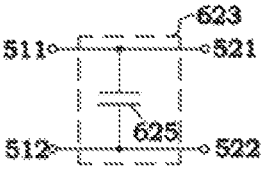
FIG. 20B is a schematic diagram of a filtering unit according to some embodiments of the present invention.

FIG. 20B is a schematic diagram of the filtering unit according to an embodiment of the present invention. Referring to FIG. 20B, filtering unit 623 includes a capacitor 625 having an end coupled to output terminal 511 and a filtering output terminal 521 and another end coupled to output terminal 512 and a filtering output terminal 522, and is configured to low-pass filter a rectified signal from output terminals 511 and 512, so as to filter out high-frequency components of the rectified signal and thereby output a filtered signal at output terminals 521 and 522.

Figure 20C:
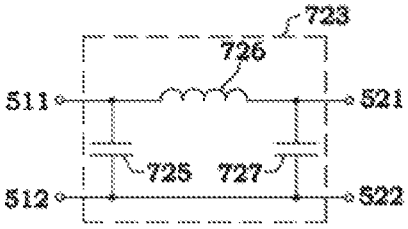
FIG. 20C is a schematic diagram of a filtering unit according to some embodiments of the present invention.

FIG. 20C is a schematic diagram of the filtering unit according to an embodiment of the present invention. Referring to FIG. 20C, filtering unit 723 comprises a pi filter circuit including a capacitor 725, an inductor 726, and a capacitor 727. As is well known, a pi filter circuit looks like the symbol 7E in its shape or structure. Capacitor 725 has an end connected to output terminal 511 and coupled to output terminal 521 through inductor 726, and has another end connected to output terminals 512 and 522. Inductor 726 is coupled between output terminals 511 and 521. Capacitor 727 has an end connected to output terminal 521 and coupled to output terminal 511 through inductor 726, and has another end connected to output terminals 512 and 522.

As seen between output terminals 511 and 512 and output terminals 521 and 522, filtering unit 723 compared to filtering unit 623 in FIG. 20B additionally has inductor 726 and capacitor 727, which are like capacitor 725 in performing low-pass filtering. Therefore, filtering unit 723 in this embodiment compared to filtering unit 623 in FIG. 20B has a better ability to filter out high-frequency components to output a filtered signal with a smoother waveform.

Inductance values of inductor 726 in the embodiment described above are chosen in some embodiments in the range of about 10 nH to about 10 mH. And capacitance values of capacitors 625, 725, and 727 in the embodiments described above are chosen in some embodiments in the range, for example, of about 100 pF to about 1 uF.

Figure 20D:
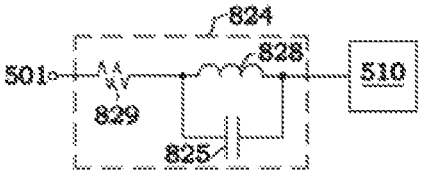
FIG. 20D is a schematic diagram of a filtering unit according to some embodiments of the present invention.

FIG. 20D is a schematic diagram of the filtering unit according to an embodiment of the present invention. Referring to FIG. 20D, filtering unit 824 includes a capacitor 825 and an inductor 828 connected in parallel. Capacitor 825 has an end coupled to pin 501, and another end coupled to rectifying output terminal 511, and is configured to high-pass filter an external driving signal input at pin 501, so as to filter out low-frequency components of the external driving signal. Inductor 828 has an end coupled to pin 501 and another end coupled to rectifying output terminal 511, and is configured to low-pass filter an external driving signal input at pin 501, so as to filter out high-frequency components of the external driving signal. Therefore, the combination of capacitor 825 and inductor 828 works to present high impedance to an external driving signal at one or more specific frequencies. Thus, the parallel-connected capacitor and inductor work to present a peak equivalent impedance to the external driving signal at a specific frequency.

Through appropriately choosing a capacitance value of capacitor 825 and an inductance value of inductor 828, a center frequency f on the high-impedance band may be set at a specific value given by, where L denotes inductance of inductor 828 and C denotes capacitance of capacitor 825. The center frequency is in some embodiments in the range of about 20~30 kHz, and may be preferably about 25 kHz. And an LED lamp with filtering unit 824 is able to be certified under safety standards, for a specific center frequency, as provided by Underwriters Laboratories (UL).

It's worth noting that filtering unit 824 may further comprise a resistor 829, coupled between pin 501 and filtering output terminal 511. In FIG. 20D, resistor 829 is connected in series to the parallel-connected capacitor 825 and inductor 828. For example, resistor 829 may be coupled between pin 501 and parallel-connected capacitor 825 and inductor 828, or may be coupled between filtering output terminal 511 and parallel-connected capacitor 825 and inductor 828. In this embodiment, resistor 829 is coupled between pin 501 and parallel-connected capacitor 825 and inductor 828. Further, resistor 829 is configured for adjusting the quality factor (Q) of the LC circuit comprising capacitor 825 and inductor 828, to better adapt filtering unit 824 to application environments with different quality factor requirements. Since resistor 829 is an optional component, it is depicted in a dotted line in FIG. 20D.

Capacitance values of capacitor 825 are in some embodiments in the range of about 10 nF-2 uF. Inductance values of inductor 828 are in some embodiments smaller than 2 mH, and may be preferably smaller than 1 mH. Resistance values of resistor 829 are in some embodiments larger than 50 ohms, and are may be preferably larger than 500 ohms.

Besides the filtering circuits shown and described in the above embodiments, traditional low-pass or band-pass filters can be used as the filtering unit in the filtering circuit in the present invention.

Figure 20E:
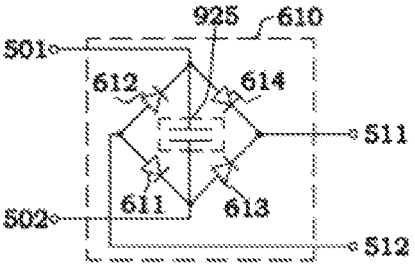
FIG. 20E is a schematic diagram of a filtering unit according to some embodiments of the present invention.

FIG. 20E is a schematic diagram of the filtering unit according to an embodiment of the present invention. Referring to FIG. 20E, in this embodiment filtering unit 925 is disposed in rectifying circuit 610 as shown in FIG. 18A, and is configured for reducing the EMI (Electromagnetic interference) caused by rectifying circuit 610 and/or other circuits. In this embodiment, filtering unit 925 includes an EMI-reducing capacitor coupled between pin 501 and the anode of rectifying diode 613, and also between pin 502 and the anode of rectifying diode 614, to reduce the EMI associated with the positive half cycle of the AC driving signal received at pins 501 and 502. The EMI-reducing capacitor of filtering unit 925 is also coupled between pin 501 and the cathode of rectifying diode 611, and between pin 502 and the cathode of rectifying diode 612, to reduce the EMI associated with the negative half cycle of the AC driving signal received at pins 501 and 502. In some embodiments, rectifying circuit 610 comprises a full-wave bridge rectifier circuit including four rectifying diodes 611, 612, 613, and 614. The full-wave bridge rectifier circuit has a first filtering node connecting an anode and a cathode respectively of two diodes 613 and 611 of the four rectifying diodes 611, 612, 613, and 614, and a second filtering node connecting an anode and a cathode respectively of the other two diodes 614 and 612 of the four rectifying diodes 611, 612, 613, and 614. And the EMI-reducing capacitor of the filtering unit 925 is coupled between the first filtering node and the second filtering node.

Similarly, with reference to FIGS. 18C, and 19A-19C, any capacitor in each of the circuits in FIGS. 19A-19C is coupled between pins 501 and 502 (or pins 503 and 504) and any diode in FIG. 18C, so any or each capacitor in FIGS. 19A-19C can work as an EMI-reducing capacitor to achieve the function of reducing EMI. For example, rectifying circuit 510 in FIGS. 17C and 17E may comprise a half-wave rectifier circuit including two rectifying diodes and having a half-wave node connecting an anode and a cathode respectively of the two rectifying diodes, and any or each capacitor in FIGS. 19A-19C may be coupled between the half-wave node and at least one of the first pin and the second pin. And rectifying circuit 540 in FIG. 17E may comprise a half-wave rectifier circuit including two rectifying diodes and having a half-wave node connecting an anode and a cathode respectively of the two rectifying diodes, and any or each capacitor in FIGS. 19A-19C may be coupled between the half-wave node and at least one of the third pin and the fourth pin.

It's worth noting that the EMI-reducing capacitor in the embodiment of FIG. 20E may also act as capacitor 825 in filtering unit 824, so that in combination with inductor 828 the capacitor 825 performs the functions of reducing EMI and presenting high impedance to an external driving signal at specific frequencies. For example, when the rectifying circuit comprises a full-wave bridge rectifier circuit, capacitor 825 of filtering unit 824 may be coupled between the first filtering node and the second filtering node of the full-wave bridge rectifier circuit. When the rectifying circuit comprises a half-wave rectifier circuit, capacitor 825 of filtering unit 824 may be coupled between the half-wave node of the half-wave rectifier circuit and at least one of the first pin and the second pin.

If any terms in this application conflict with terms used in any application(s) from which this application claims priority, or terms incorporated by reference into this application or the application(s) from which this application claims priority, a construction based on the terms as used or defined in this application should be applied.

While the instant disclosure related to an LED tube lamp has been described by way of example and in terms of the preferred embodiments, it is to be understood that the instant disclosure needs not be limited to the disclosed embodiments. For anyone skilled in the art, various modifications and improvements within the spirit of the instant disclosure are covered under the scope of the instant disclosure. The covered scope of the instant disclosure is based on the appended claims.

What is claimed is:

1. An LED tube lamp, comprising:

a glass tube covered by a heat shrink sleeve and having two end portions; a plurality of LED light sources;

two end caps respectively sleeving the two end portions of the glass tube;

a power supply in one of the end caps or separately in both of the end caps; and an LED light strip on an inner surface of the glass tube forming a freely extending end portion at one end along a longitudinal direction of the glass tube, the freely extending end portion directly soldered to the power supply, the plurality of LED light sources being on the LED light strip;

wherein each of the end caps comprises:

an end wall; and two conductive pins on the end wall.

2. The LED tube lamp according to claim 1, further comprising at least two openings on the end wall symmetric to each other with respect to a plane passing through the middle of a line connecting the two pins and perpendicular to the line connecting the two pins.

3. The LED tube lamp according to claim 2, wherein the at least two openings are on a surface of the end wall on which the two pins are disposed.

4. The LED tube lamp according to claim 3, wherein the at least two openings are separately in a shape of an arc.

5. The LED tube lamp according to claim 4, wherein the at least two openings are in a shape of arcs with different sizes.

6. The LED tube lamp according to claim 5, wherein the sizes of the arcs of the at least two openings gradually vary.

7. The LED tube lamp according to claim 6, wherein the heat shrink sleeve is substantially transparent with respect to the wavelength of light from the LED light sources.

8. The LED tube lamp according to claim 1, wherein the number of the at least two openings is six in two sets, and the three openings in one set are in a shape of three arcs with gradually varying sizes.

9. The LED tube lamp according to claim 1, wherein at least a part of the openings are arranged along an arc and spaced apart from each other.

10. An LED tube lamp, comprising:

a glass tube comprising an inner surface and an outer surface, at least part of the inner surface of the glass tube has a rough surface, the glass tube having two end portions;

a plurality of LED light sources;

two end caps respectively sleeving the two end portions of the glass tube;

a power supply in one of the end caps or separately in both of the end caps; and an LED light strip on the inner surface of the glass tube forming a freely extending end portion at one end along a longitudinal direction of the glass tube, the freely extending end portion directly soldered to the power supply, the plurality of LED light sources being on the LED light strip.

11. The LED tube lamp according to claim 10, wherein the roughness of the rough surface is substantially from 0.1 to 40 μm.

12. The LED tube lamp according to claim 10, wherein each of the end caps comprises a plurality of openings thereon, and the two sets of the plurality of openings are symmetric to each other with respect to a virtual central axis of the end cap.

13. The LED tube lamp according to claim 12, wherein the plurality of openings dissipate heat resulted from the power supply.

14. The LED tube lamp according to claim 10, wherein the plurality of openings are separately in a shape of an arc.

15. The LED tube lamp according to claim 14, wherein the number of the plurality of openings is three, and the three openings are in a shape of three arcs with gradually varying sizes.

16. The LED tube lamp according to claim 10, wherein the plurality of openings are separately in a shape of a circle.

17. The LED tube lamp according to claim 16, wherein the number of the plurality of openings is three, and the three openings are arranged in a shape of an arc.

18. The LED tube lamp according to claim 12, wherein at least a part of the openings are arranged along an arc and spaced apart from each other.

19. An LED tube lamp, comprising:

a glass tube having two end portions;

a plurality of LED light sources;

two end caps respectively sleeving the two end portions of the glass tube, each of the end caps comprising two pins and a plurality of openings, the two pins being on a surface of the end cap, the plurality of openings being on the surface of the end cap and divided into two sets, and the two sets of the openings being symmetric to each other with respect to a plane passing through the two pins;

a power supply disposed in at least one of the end caps; and an LED light strip on an inner surface of the glass tube forming a freely extending end portion at one end along a longitudinal direction of the glass tube, the freely extending end portion directly soldered to the power supply, the plurality of LED light sources being on the LED light strip.

20. The LED tube lamp according to claim 19, wherein the power supply comprises a current-limiting element, and the plurality of openings dissipate heat resulted from the power supply.

21. The LED tube lamp according to claim 20, wherein the plurality of openings are separately in a shape of an arc.

22. The LED tube lamp according to claim 20, wherein the surface of the end cap is vertical to the length direction of the glass tube.

23. The LED tube lamp according to claim 21, wherein the plurality of openings are in a shape of arcs with different sizes.

24. The LED tube lamp according to claim 23, wherein the sizes of the arcs of the plurality of openings gradually vary.

25. The LED tube lamp according to claim 20, wherein the plurality of openings are separately in a shape of a circle.

26. The LED tube lamp according to claim 25, wherein the number of the plurality of openings is three, and the three openings are arranged in a shape of an arc.

27. The LED tube lamp according to claim 20, wherein the plurality of openings are a combination in a shape of an arc and a circle.

28. The LED tube lamp according to claim 20, wherein at least a part of the openings are arranged along an arc and spaced apart from each other.

29. An LED tube lamp, comprising:

a glass tube;

a plurality of LED light sources;

two end caps respectively at two opposite ends of the glass tube;

a power supply in one of the end caps or separately in both of the end caps; and an LED light strip on an inner surface of the glass tube forming a freely extending end portion at one end along a longitudinal direction of the glass tube, the freely extending end portion directly soldered to the power supply, the plurality of LED light sources being on the LED light strip;

wherein each of the end caps comprises:

an end wall;

two pins on the end wall; and at least two openings on the end wall symmetric to each other with respect to a plane passing through the middle of a line connecting the two pins and perpendicular to the line connecting the two pins.

30. The LED tube lamp according to claim 29, wherein the at least two openings are separately in a shape of an arc.

31. The LED tube lamp according to claim 1, wherein the LED light strip is a bendable circuit sheet.

32. The LED tube lamp according to claim 1, wherein the end cap comprises a metal part.

33. The LED tube lamp according to claim 10, wherein the LED light strip is a bendable circuit sheet.

34. The LED tube lamp according to claim 10, wherein the end cap comprises a metal part.

35. The LED tube lamp according to claim 19, wherein the LED light strip is a bendable circuit sheet.

36. The LED tube lamp according to claim 19, wherein the end cap comprises a metal part.

37. The LED tube lamp according to claim 29, wherein the LED light strip is a bendable circuit sheet.

38. The LED tube lamp according to claim 29, wherein the end cap comprises a metal part.

39. The LED tube lamp according to claim 20, wherein the current-limiting element comprises a resistor, a capacitor, an inductor, or any combination thereof.

40. The LED tube lamp according to claim 20, wherein the current-limiting element is configured for reducing EMI (electromagnetic interference).

41. The LED tube lamp according to claim 20, wherein the current-limiting element is an element of, or constitutes, a terminal adapter circuit.

42. The LED tube lamp according to claim 19, wherein the power supply comprises a rectifying circuit and a filtering circuit disposed in at least one of the end caps, and the plurality of openings are for dissipating heat from the power supply.

43. The LED tube lamp according to claim 19, wherein the power supply comprises a fuse connected to one of the two pins of one of the end caps, and the plurality of openings are for dissipating heat from the power supply.

44. The LED tube lamp according to claim 29, wherein the power supply comprises a current-limiting element disposed in at least one of the end caps, and the at least two openings are for dissipating heat from the power supply.

45. The LED tube lamp according to claim 44, wherein the current-limiting element comprises a resistor, a capacitor, an inductor, or any combination thereof.

46. The LED tube lamp according to claim 44, wherein the current-limiting element is configured for reducing EMI.

47. The LED tube lamp according to claim 29, wherein the power supply comprises a rectifying circuit and a filtering circuit disposed in at least one of the end caps, and the at least two openings are for dissipating heat from the power supply.

48. The LED tube lamp according to claim 29, wherein the power supply comprises a fuse connected to one of the two pins of one of the end caps, and the at least two openings are for dissipating heat from the power supply.

49. The LED tube lamp according to claim 19, wherein the power supply further comprises a circuit board with two second bond pads.

50. The LED tube lamp according to claim 49, wherein each of the second bond pads comprises a through-hole.

51. The LED tube lamp according to claim 50, wherein the circuit board comprises an electrically insulating hole formed and disposed between the two second bond pads.

52. The LED tube lamp according to claim 19, wherein the power supply further comprises a circuit board with an electrically insulating hole.

53. The LED tube lamp according to claim 52, wherein the electrically insulating hole is formed and disposed near the edge of the circuit board.

54. The LED tube lamp according to claim 19, wherein the light bar comprises two first bond pads at a first end.

55. The LED tube lamp according to claim 54, wherein each of the first bond pads comprises a notch at an edge of the LED light bar.

56. The LED tube lamp according to claim 55, wherein at least one of the first bond pads is formed with a solder ball above the notch after soldering is completed, and a diameter of the solder ball is larger than a diameter of the notch.

57. The LED tube lamp according to claim 19, wherein the power supply further comprises a circuit board with a different width from the width of the light bar.

58. The LED tube lamp according to claim 19, wherein the power supply comprises a printed circuit board and the light bar comprises a bendable circuit sheet.

59. The LED tube lamp according to claim 29, wherein the power supply further comprises a circuit board with two second bond pads.

60. The LED tube lamp according to claim 59, wherein each of the second bond pads comprises a through-hole.

61. The LED tube lamp according to claim 60, wherein the circuit board comprises an electrically insulating hole formed and disposed between the two second bond pads.

62. The LED tube lamp according to claim 29, wherein the power supply further comprises a circuit board with an electrically insulating hole.

63. The LED tube lamp according to claim 62, wherein the electrically insulating hole is formed and disposed near the edge of the circuit board.

64. The LED tube lamp according to claim 29, wherein the light bar comprises two first bond pads at a first end.

65. The LED tube lamp according to claim 64, wherein each of the first bond pads comprises a notch at an edge of the LED light bar.

66. The LED tube lamp according to claim 65, wherein at least one of the first bond pads is formed with a solder ball above the notch after soldering is completed, and a diameter of the solder ball is larger than a diameter of the notch.

67. The LED tube lamp according to claim 29, wherein the power supply further comprises a circuit board with a different width from the width of the light bar.

68. The LED tube lamp according to claim 29, wherein the power supply comprises a printed circuit board and the light bar comprises a bendable circuit sheet.

* * * * *